US009746222B2

(12) United States Patent
Morimoto et al.

(10) Patent No.: US 9,746,222 B2
(45) Date of Patent: Aug. 29, 2017

(54) AIR-CONDITIONING APPARATUS

(75) Inventors: Hiroyuki Morimoto, Tokyo (JP); Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 684 days.

(21) Appl. No.: 14/343,878

(22) PCT Filed: Dec. 22, 2011

(86) PCT No.: PCT/JP2011/007197

§ 371 (c)(1),
(2), (4) Date: Mar. 10, 2014

(87) PCT Pub. No.: WO2013/093977

PCT Pub. Date: Jun. 27, 2013

(65) Prior Publication Data

US 2014/0216082 A1 Aug. 7, 2014

(51) Int. Cl.

| | |
|---|---|
| ***F25B 49/00*** | (2006.01) |
| ***F25B 9/00*** | (2006.01) |
| *F25B 13/00* | (2006.01) |
| *F25B 25/00* | (2006.01) |

(52) U.S. Cl.

CPC ..... *F25B 49/005* (2013.01); *F25B 9/006* (2013.01); *F25B 13/00* (2013.01); *F25B 25/005* (2013.01); *F25B 2313/0231* (2013.01); *F25B 2400/121* (2013.01); *F25B 2600/21* (2013.01); *F25B 2700/21174* (2013.01); *F25B 2700/21175* (2013.01)

(58) Field of Classification Search

CPC ..... F25B 49/005; F25B 9/006; F25B 2700/21175; F25B 2700/21174; F25B 2600/21; F25B 13/00; F25B 2400/121; F25B 2313/0231

See application file for complete search history.

(56) References Cited

U.S. PATENT DOCUMENTS 5,996,358 A * 12/1999 Sumida ..... C09K 5/045 62/114

FOREIGN PATENT DOCUMENTS

| | | | |
|---|---|---|---|
| EP | 0898133 | A2 | 2/1999 |
| JP | H07-280366 | A | 10/1995 |
| JP | H08-075280 | A | 3/1996 |
| JP | H09-014771 | A | 1/1997 |
| JP | H11-063747 | A | 3/1999 |
| JP | 2009-257741 | A | 11/2009 |

OTHER PUBLICATIONS

Extended European Search Report issued on Aug. 5, 2015 in the corresponding EP Application No. 11877609.5.
Office Action dated May 19, 2015 in the corresponding CN application No. 201180074351.1 ( English translation attached ).
International Search Report mailed Feb. 7, 2012 for the corresponding international application No. PCT/JP2011/007197.

* cited by examiner

*Primary Examiner* — Len Tran
*Assistant Examiner* — Ana Vazquez
(74) *Attorney, Agent, or Firm* — Posz Law Group, PLC

(57) ABSTRACT

A computing device calculates an evaporating temperature Te* and a dew-point temperature Tdew* from a quality X, a temperature glide ΔT determined by a difference between a boiling temperature and a dew-point temperature at a predetermined pressure, and a refrigerant temperature detected by second temperature detection device.

9 Claims, 12 Drawing Sheets

TEMPERATURE GLIDE $\Delta T = Tdew - Tbub$

AIR-CONDITIONING APPARATUS

CROSS REFERENCE TO RELATED APPLICATION

This application is a U.S. national stage application of international Application No. PCT/JP2011/007197 filed on Dec. 22, 2011, the disclosure of which is incorporated by reference.

TECHNICAL FIELD

The present invention relates to an air-conditioning apparatus applied, for example, to multi-air-conditioning apparatuses for buildings.

BACKGROUND ART

Air-conditioning apparatuses include one in which, like a multi-air-conditioning apparatus for buildings, a heat source (outdoor unit) is installed outside a building and an indoor unit is installed inside the building. A refrigerant that circulates in a refrigerant circuit of the air-conditioning apparatus transfers heat to (or receives heat from) air supplied to a heat exchanger of the indoor unit so as to heat or cool the air. Then, the heated or cooled air is sent to an air-conditioned space for heating or cooling the space.

Such an air-conditioning apparatus often includes a plurality of indoor units, because a building typically has a plurality of indoor spaces. In the case of a large building, a refrigerant pipe that connects the outdoor unit and each indoor unit may reach as long as 100 m. The longer the pipe that connects the outdoor unit and the indoor unit, the larger the amount of refrigerant charged into the refrigerant circuit.

An indoor unit of such a multi-air-conditioning apparatus for buildings is typically installed and used in an indoor space (e.g., office space, room, or shop) where there are people. If for some reason a refrigerant leaks from the indoor unit installed in the indoor space, since the refrigerant may be flammable or toxic depending on its type, the leakage may cause safety or health problems. Even if the refrigerant is harmless to the human body, the leakage of the refrigerant may lower the concentration of oxygen in the indoor space and negatively affect the human body.

As a solution to this, an air-conditioning apparatus may use a secondary loop method in which, for air-conditioning of a space where there are people, a primary-side loop is operated with a refrigerant, and a secondary-side loop is operated with harmless water or brine.

For prevention of global warming, there has been a demand for development of air-conditioning apparatuses that use a refrigerant with a low global warming potential (hereinafter may also be referred to as GWP). Promising low GWP refrigerants include R32, HFO1234yf, and HFO1234ze (E). Adopting only R32 as a refrigerant does not involve significant design changes to the current apparatus and requires only a small development load, because R32 has substantially the same physical properties as R410A which is currently most often used. However, R32 has a GWP of 675, which is a little high. On the other hand, if HFO1234yf or HFO1234ze (E) alone is adopted as a refrigerant, the pressure of the refrigerant is low because of its small density in a low-pressure state (gas state or two-phase gas-liquid gas state), and thus the loss of pressure increases. However, increasing the diameter (inside diameter) of a refrigerant pipe to reduce the loss of pressure leads to a higher cost.

By using a mixture of R32 and HFO1234yf or HFO1234ze (E) as a refrigerant, it is possible to reduce the GWP while increasing the pressure of the refrigerant. Since R32, HFO1234yf, and HFO1234ze (E) have different boiling points, the resulting refrigerant mixture is a non-azeotropic refrigerant mixture.

It is known that in an air-conditioning apparatus using a non-azeotropic refrigerant mixture, the composition of the refrigerant charged in the apparatus is different from the composition of the refrigerant actually circulating in the refrigeration cycle. This is because the boiling points of the mixed refrigerants are different as described above. The change in refrigerant composition during circulation causes the degree of superheat or subcooling to deviate from the original value, makes it difficult to optimally control the opening degree of an expansion device and various other devices, and leads to degraded performance of the air-conditioning apparatus. To reduce such performance degradation, various refrigerating and air-conditioning apparatuses with means for detecting a refrigerant composition have been proposed (see, e.g., Patent Literatures 1 and 2).

The technique described in Patent Literature 1 includes a bypass that is connected to bypass a compressor, and a double-pipe heat exchanger and a capillary tube are connected to the bypass. A refrigerant composition is calculated on the basis of detection results of pressure detection means and temperature detection means provided in the bypass and a refrigerant composition tentatively set.

Like the technique described in Patent Literature 1, the technique described in Patent Literature 2 includes a bypass that is connected to bypass a compressor, and a double-pipe heat exchanger and a capillary tube are connected to the bypass. A refrigerant composition is calculated on the basis of detection results of pressure detection means and temperature detection means provided in the bypass and a refrigerant composition tentatively set.

CITATION LIST

Patent Literature

Patent Literature 1: Japanese Unexamined Patent Application Publication No. 8-75280 (e.g., page 5, FIG. 1)

Patent Literature 2: Japanese Unexamined Patent Application Publication No. 11-63747 (e.g., page 5, FIG. 1)

SUMMARY OF INVENTION

Technical Problem

The techniques described in Patent Literatures 1 and 2 include a bypass which is connected to bypass a compressor. A double-pipe heat exchanger and a capillary tube are connected to the bypass, and a refrigerant gas is liquefied by evaporation heat of the refrigerant itself. With these techniques, the cooling and heating capacities may be degraded, because a discharge side and a suction side of the compressor are bypassed.

Also, the techniques described in Patent Literatures 1 and 2 suffer increased costs, because the techniques involve the addition of a double-pipe heat exchanger and two detection means (temperature detection means and pressure detection means) to detect a refrigerant circulation composition.

An object of the present invention is to provide a less costly air-conditioning apparatus configured to highly accurately calculate an evaporating temperature and a dew-point temperature of a non-azeotropic refrigerant mixture, and properly control a refrigeration cycle on the basis of the calculated values.

Solution to Problem

An air-conditioning apparatus according to the present invention is one in which a compressor, a first heat exchanger, an expansion device, and a second heat exchanger are connected by pipes to form a refrigeration cycle, and a non-azeotropic refrigerant mixture is adopted as a refrigerant circulating in the refrigerant cycle. The air-conditioning apparatus includes first temperature detection means disposed on an inlet side of the expansion device, and second temperature detection means disposed on an outlet side of the expansion device. An evaporating temperature Te* and a dew-point temperature Tdew* are calculated from a quality Xr of the refrigerant on a downstream side of the expansion device, a temperature glide ΔT determined by a difference between a boiling temperature and a dew-point temperature at a predetermined pressure, and a refrigerant temperature detected by the second temperature detection means, the quality Xr being calculated on a basis of an inlet liquid enthalpy calculated on a basis of a refrigerant temperature detected by the first temperature detection means, and a saturated liquid enthalpy and a saturated gas enthalpy calculated on a basis of the refrigerant temperature detected by the second temperature detection means.

Advantageous Effects of Invention

The air-conditioning apparatus according to the present invention is capable of calculating an evaporating temperature and a dew-point temperature of a non-azeotropic refrigerant mixture by using temperature sensors. Since temperature sensors, which are relatively low-cost, can be used, a less costly air-conditioning apparatus can be realized. The air-conditioning apparatus according to the present invention is capable of accurately calculating an evaporating temperature and a dew-point temperature of a non-azeotropic refrigerant mixture by using temperature sensors, performing a stable operation, and providing stable performance.

DESCRIPTION OF EMBODIMENTS

Embodiment of the present invention will now be described with reference to the drawings.

Figure 1:
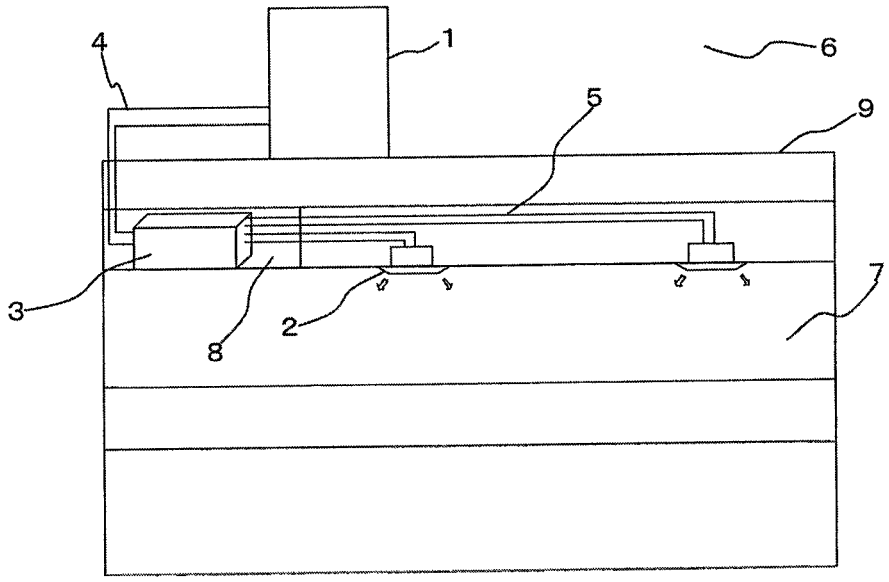
FIG. 1 is a schematic view illustrating an example of installation of an air-conditioning apparatus according to Embodiment of the present invention.

FIG. 1 is a schematic view illustrating an example of installation of an air-conditioning apparatus according to Embodiment of the present invention. The example of installation of the air-conditioning apparatus according to Embodiment will be described with reference to FIG. 1. The air-conditioning apparatus includes a refrigeration cycle for circulating a refrigerant. Each of indoor units 2 can freely select a cooling mode or a heating mode as an operation mode. Note that in the drawings including FIG. 1, size relationships among the illustrated components may be different from actual size relationships.

The air-conditioning apparatus according to Embodiment includes a refrigerant circuit A (see FIG. 2) which uses a non-azeotropic refrigerant mixture as a refrigerant, and a heat medium circuit B (see FIG. 2) which uses water or the like as a heat medium. The air-conditioning apparatus has an improved feature for calculating an evaporating temperature and a dew-point temperature of the non-azeotropic refrigerant mixture that circulates in the refrigerant circuit A.

In Embodiment, a non-azeotropic refrigerant mixture composed of R32 and HFO1234yf is used. A low-boiling point refrigerant is R32 and a high-boiling point refrigerant is HFO1234yf. Unless otherwise specified, a refrigerant composition in Embodiment refers to a composition of R32 which is a low-boiling point refrigerant that circulates in the refrigeration cycle.

HFO1234ze (E) exists in the form of two geometric isomers: a trans isomer in which F and CF3 are located on opposite sides of a double bond, and a cis isomer in which F and CF3 are located on the same side of a double bond. HFO1234ze (E) according to Embodiment is a trans isomer. In the IUPAC system of nomenclature, HFO1234ze (E) is named as trans-1,3,3,3-tetrafluoro-1-propene.

The air-conditioning apparatus according to Embodiment adopts a method (indirect method) that indirectly uses a refrigerant (heat-source-side refrigerant). Specifically, the air-conditioning apparatus transfers cooling energy or heating energy stored in the heat-source-side refrigerant to a refrigerant (hereinafter referred to as a heat medium) different from the heat-source-side refrigerant, and thereby cools or heats an air-conditioned space with the cooling energy or heating energy stored in the heat medium.

As illustrated in FIG. 1, the air-conditioning apparatus according to Embodiment includes one outdoor unit 1 serving as a heat source device, a plurality of indoor units 2, and a heat medium relay unit 3 disposed between the outdoor unit 1 and the indoor units 2. The heat medium relay unit 3 allows heat exchange between the heat-source-side refrigerant and the heat medium. The outdoor unit 1 and the heat medium relay unit 3 are connected to each other by refrigerant pipes 4 for circulating the heat-source-side refrigerant. The heat medium relay unit 3 and each of the indoor units 2 are connected to each other by pipes (heat medium pipes) 5 for circulating the heat medium. Cooling energy or heating energy generated by the outdoor unit 1 is delivered via the heat medium relay unit 3 to the indoor units 2.

The outdoor unit 1 is typically placed in an outdoor space 6 which is a space (e.g., rooftop) outside a building 9. The outdoor unit 1 supplies cooling energy or heating energy via the heat medium relay unit 3 to the indoor units 2.

The indoor units 2 are each placed at a location from which cooling air or heating air can be supplied to an indoor space 7 which is a space (e.g., room) inside the building 9. The indoor units 2 supply cooling air or heating air to the indoor space 7 which is to be an air-conditioned space.

The heat medium relay unit 3 is housed in a housing separate from those for the outdoor unit 1 and the indoor units 2, and is placed at a location different from the outdoor space 6 and the indoor space 7. The heat medium relay unit 3 is connected via the refrigerant pipes 4 to the outdoor unit 1, and connected via the pipes 5 to the indoor units 2. The heat medium relay unit 3 transfers, to the indoor units 2, cooling energy or heating energy supplied from the outdoor unit 1.

As illustrated in FIG. 1, in the air-conditioning apparatus according to Embodiment, the outdoor unit 1 and the heat medium relay unit 3 are connected via two refrigerant pipes 4, and the heat medium relay unit 3 and each indoor unit 2 is connected via two pipes 5. Thus, connecting the different units (outdoor unit 1, indoor units 2, and heat medium relay unit 3) via the refrigerant pipes 4 and the pipes 5 facilitates construction of the air-conditioning apparatus according to Embodiment.

FIG. 1 illustrates an example where the heat medium relay unit 3 is installed in a space inside the building 9 but not in the indoor space 7. Specifically, in FIG. 1, the heat medium relay unit 3 is installed in a space above a ceiling (e.g., a space above the ceiling in the building 9, hereinafter simply referred to as a space 8). The heat medium relay unit 3 may be installed in a shared space, such as a space where there is an elevator. Although the indoor units 2 are of a ceiling cassette type in FIG. 1, the type of the indoor units 2 is not limited to this. That is, the air-conditioning apparatus 100 may be of a ceiling concealed type, a ceiling suspended type, or any other type, as long as heating air or cooling air can be blown either directly or through ducts to the indoor space 7.

Although the outdoor unit 1 is installed in the outdoor space 6 in FIG. 1, the location of installation is not limited to this. For example, the outdoor unit 1 may be installed in a confined space, such as a machine room with ventilation openings, or may be installed inside the building 9 as long as waste heat can be discharged through an exhaust duct to the outside of the building 9. Even when the outdoor unit 1 is a water-cooled unit, the outdoor unit 1 may be installed inside the building 9. Installing the outdoor unit 1 in such a location causes no particular problems.

The heat medium relay unit 3 may be installed near the outdoor unit 1. However, it should be noted that if the distance from the heat medium relay unit 3 to the indoor units 2 is too long, the energy-saving effect will be reduced, because a very large amount of power is required to convey the heat medium. The number of different types of units (the outdoor unit 1, the indoor units 2, and the heat medium relay unit 3) connected to each other is not limited to that illustrated in FIG. 1, and may be determined, for example, depending on the building 9 where the air-conditioning apparatus according to Embodiment is installed.

Figure 2:
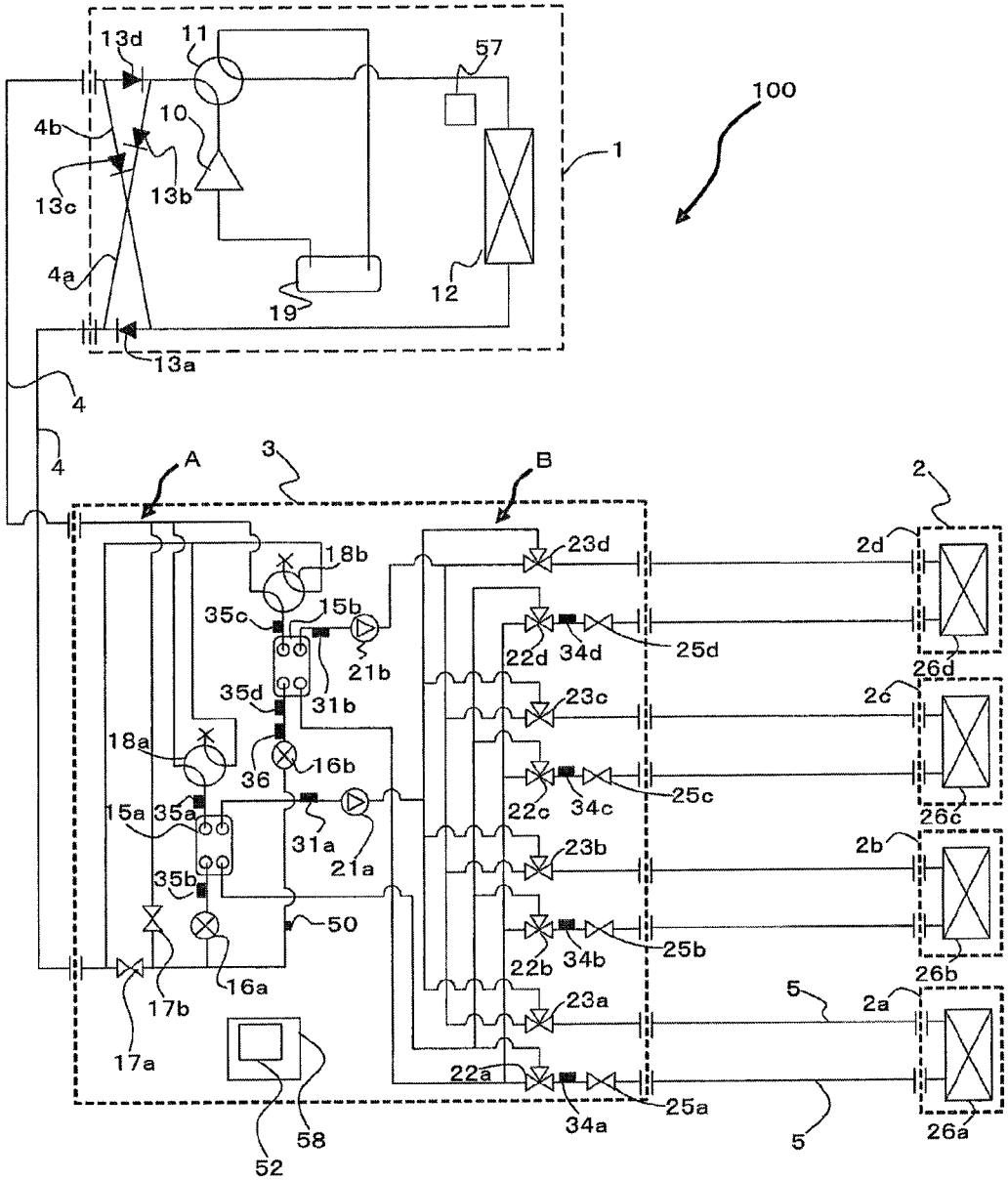
FIG. 2 is a schematic circuit configuration diagram illustrating a circuit configuration of the air-conditioning apparatus according to Embodiment of the present invention.

FIG. 2 is a schematic circuit configuration diagram illustrating a circuit configuration of the air-conditioning apparatus according to Embodiment (hereinafter referred to as an air-conditioning apparatus 100). A detailed configuration of the air-conditioning apparatus 100 will be described with reference to FIG. 2. As illustrated in FIG. 2, the outdoor unit 1 and the heat medium relay unit 3 are connected to each other by the refrigerant pipes 4 via an intermediate heat exchanger 15*a* and an intermediate heat exchanger 15*b* included in the heat medium relay unit 3. The heat medium relay unit 3 and each of the indoor units 2 are connected to each other by the pipes 5 also via the intermediate heat exchanger 15*a* and the intermediate heat exchanger 15*b*. The refrigerant pipes 4 and the pipes 5 will be described in detail later on.

[Outdoor Unit 1]

The outdoor unit 1 includes a compressor 10 that compresses the refrigerant, a first refrigerant flow switching device 11 formed by a four-way valve or the like, a heat-source-side heat exchanger 12 serving as an evaporator or a condenser, and an accumulator 19 that stores an excess refrigerant. These components of the outdoor unit 1 are connected to the refrigerant pipes 4.

The outdoor unit 1 is provided with a first connecting pipe 4*a*, a second connecting pipe 4*b*, a check valve 13*a*, a check valve 13*b*, a check valve 13*c*, and a check valve 13*d*. With the first connecting pipe 4*a*, the second connecting pipe 4*b*, the check valve 13*a*, the check valve 13*b*, the check valve 13*c*, and the check valve 13*d*, the flow of the heat-source-side refrigerant into the heat medium relay unit 3 can be regulated in a given direction, regardless of the operation requested by any indoor unit 2.

The compressor 10 sucks in the heat-source-side refrigerant, and compresses the heat-source-side refrigerant into a high-temperature high-pressure state. For example, the compressor 10 may be formed by a capacity-controllable inverter compressor.

The first refrigerant flow switching device 11 switches the flow of the heat-source-side refrigerant between a heating operation mode (a heating only operation mode and a heating main operation mode) and a cooling operation mode (a cooling only operation mode and a cooling main operation mode).

The heat-source-side heat exchanger 12 serves as an evaporator during heating operation, serves as a condenser during cooling operation, and allows heat exchange between air supplied from an air-sending device such as a fan (not shown) and the heat-source-side refrigerant.

The accumulator 19 is disposed on the suction side of the compressor 10. The accumulator 19 stores an excess refrigerant produced by a difference between the heating operation mode and the cooling operation mode, and an excess refrigerant produced by a transient change in operation (e.g., a change in the number of the indoor units 2 in operation) or produced depending on the load condition. In the accumulator 19, the refrigerant is separated into a liquid-phase refrigerant containing more high-boiling point refrigerant and a gas-phase refrigerant containing more low-boiling point refrigerant. The liquid-phase refrigerant containing more high-boiling point refrigerant is stored in the accumulator 19. Therefore, when there is a liquid-phase refrigerant in the accumulator 19, more low-boiling point refrigerant tends to be contained in the composition of the refrigerant circulating in the air-conditioning apparatus 100.

A controller 57 is included in the outdoor unit 1. In accordance with composition information transmitted from a controller in the heat medium relay unit 3 described below, the controller 57 controls actuation elements (actuators), such as the compressor 10 and others, included in the outdoor unit 1.

[Indoor Units 2]

Each of the indoor units 2 includes a use-side heat exchanger 26. The use-side heat exchanger 26 is connected by the pipes 5 to the corresponding heat medium flow control device 25 and the corresponding second heat medium flow switching device 23 of the heat medium relay unit 3. The use-side heat exchanger 26 allows heat exchange between air supplied from an air-sending device such as a fan (not shown) and the heat medium, and generates heating air or cooling air to be supplied to the indoor space 7.

FIG. 2 illustrates an example where four indoor units 2 are connected to the heat medium relay unit 3. In FIG. 2, the indoor unit 2*a*, the indoor unit 2*b*, the indoor unit 2*c*, and the indoor unit 2*d* are arranged in this order from the bottom of the drawing. Regarding the use-side heat exchanges 26, the use-side heat exchanger 26*a*, the use-side heat exchanger 26*b*, the use-side heat exchanger 26*c*, and the use-side heat exchanger 26*d* are also arranged in this order from the bottom of the drawing, to correspond to the respective indoor units 2*a* to 2*d*. Note that the number of connected indoor units 2 is not limited to four illustrated in FIG. 2.

[Heat Medium Relay Unit 3]

The heat medium relay unit 3 includes two intermediate heat exchangers 15 for heat exchange between the refrigerant and the heat medium, two expansion devices 16 for reducing the pressure of the refrigerant, two opening and closing devices 17 for opening and closing the passages of the refrigerant pipes 4, two second refrigerant flow switching devices 18 for switching the refrigerant passages, two pumps 21 for circulating the heat medium, four first heat medium flow switching devices 22 connected to one side of the respective pipes 5, four second heat medium flow switching devices 23 connected to other side of the respective pipes 5, and four heat medium flow control devices 25 connected to the respective pipes 5 to which the second heat medium flow switching devices 22 are connected.

The two intermediate heat exchangers 15 (the intermediate heat exchanger 15*a* and the intermediate heat exchanger 15*b*, hereinafter may be collectively referred to as the intermediate heat exchangers 15) each serve as a condenser (radiator) or an evaporator, allow heat exchange between the heat-source-side refrigerant and the heat medium, and transfer cooling energy or heating energy generated by the outdoor unit 1 and stored in the heat-source-side refrigerant to the heat medium. The intermediate heat exchanger 15*a* is disposed between an expansion device 16*a* and a second refrigerant flow switching device 18*a* in the refrigerant circuit A, and used for cooling the heat medium in a cooling and heating mixed operation mode. The intermediate heat exchanger 15*b* is disposed between an expansion device 16*b* and a second refrigerant flow switching device 18*b* in the refrigerant circuit A, and used for heating the heat medium in the cooling and heating mixed operation mode.

The two expansion devices 16 (the expansion device 16*a* and the expansion device 16*b*, hereinafter may be collectively referred to as the expansion devices 16) each serve as a pressure reducing valve or an expansion valve, and reduce the pressure of the heat-source-side refrigerant and expand it. The expansion device 16*a* is disposed upstream of the intermediate heat exchanger 15*a* in the direction in which the heat-source-side refrigerant flows in the cooling only operation mode. The expansion device 16*b* is disposed upstream of the intermediate heat exchanger 15*b* in the direction in which the heat-source-side refrigerant flows in the cooling only operation mode. The two expansion devices 16 may each be formed by a device having a variably controllable opening degree, such as an electronic expansion valve.

The two opening and closing devices 17 (the opening and closing device 17*a* and the opening and closing device 17*b*) are each formed by a two-way valve or the like, and open and close the corresponding refrigerant pipe 4. The opening and closing device 17*a* is located in the refrigerant pipe 4 on the heat-source-side refrigerant inlet side. The opening and closing device 17*b* is located in a pipe that connects the refrigerant pipes 4 on the heat-source-side refrigerant inlet and outlet sides.

The two second refrigerant flow switching devices 18 (the second refrigerant flow switching device 18*a* and the second refrigerant flow switching device 18*b*, hereinafter may be collectively referred to as the second refrigerant flow switching devices 18) are each formed by a four-way valve or the like, and switch the flow of the heat-source-side refrigerant depending on the operation mode. The second refrigerant flow switching device 18*a* is disposed downstream of the intermediate heat exchanger 15*a* in the direction in which the heat-source-side refrigerant flows in the cooling only operation mode. The second refrigerant flow switching device 18*b* is disposed downstream of the intermediate heat exchanger 15*b* in the direction in which the heat-source-side refrigerant flows in the cooling only operation mode.

The two pumps 21 (a pump 21*a* and a pump 21*b*, hereinafter may be collectively referred to as the pumps 21) circulate the heat medium in the pipes 5. The pump 21*a* is provided in the pipe 5 between the intermediate heat exchanger 15*a* and the second heat medium flow switching devices 23. The pump 21*b* is provided in the pipe 5 between the intermediate heat exchanger 15*b* and the second heat medium flow switching devices 23. The two pumps 21 may be formed, for example, by capacity-controllable pumps. The pump 21*a* may be provided in the pipe 5 between the intermediate heat exchanger 15*a* and the first heat medium flow switching devices 22. The pump 21*b* may be provided in the pipe 5 between the intermediate heat exchanger 15*b* and the first heat medium flow switching devices 22.

The four first heat medium flow switching devices 22 (a first heat medium flow switching device 22*a* to a first heat medium flow switching device 22*d*, hereinafter may be collectively referred to as the first heat medium flow switching devices 22) are each formed by a three-way valve or the like, and switch the passage of the heat medium. The number of the first heat medium flow switching devices 22 is determined in accordance with the number of the indoor units 2 installed (which is four here). Each of the first heat medium flow switching devices 22 is connected at one of the three ports thereof to the intermediate heat exchanger 15*a*, connected at another of the three ports thereof to the intermediate heat exchanger 15*b*, and connected at the remaining one of the three ports thereof to the corresponding heat medium flow control device 25. The first heat medium flow switching devices 22 are each located on the outlet side of the heat medium passage of the corresponding use-side heat exchanger 26. In the drawing, the first heat medium flow switching device 22*a*, the first heat medium flow switching device 22*b*, the first heat medium flow switching device 22*c*, and the first heat medium flow switching device 22*d* are arranged, in this order from the bottom of the drawing, to correspond to the respective indoor units 2. Note that switching the heat medium passage includes not only complete switching from one to another, but also includes partial switching from one to another.

The four second heat medium flow switching devices 23 (a second heat medium flow switching device 23*a* to a second heat medium flow switching device 23*d*, hereinafter may be collectively referred to as the second heat medium flow switching devices 23) are each formed by a three-way valve or the like, and switch the passage of the heat medium. The number of the second heat medium flow switching devices 23 is determined in accordance with the number of the indoor units 2 installed (which is four here). Each of the second heat medium flow switching devices 23 is connected at one of the three ports thereof to the intermediate heat exchanger 15*a*, connected at another of the three ports thereof to the intermediate heat exchanger 15*b*, and connected at the remaining one of the three ports thereof to the corresponding use-side heat exchanger 26. The second heat medium flow switching devices 23 are each located on the inlet side of the heat medium passage of the corresponding use-side heat exchanger 26. In the drawing, the second heat medium flow switching device 23*a*, the second heat medium flow switching device 23*b*, the second heat medium flow switching device 23*c*, and the second heat medium flow switching device 23*d* are arranged, in this order from the bottom of the drawing, to correspond to the respective indoor units 2. Note that switching the heat medium passage includes not only complete switching from one to another, but also includes partial switching from one to another.

The four heat medium flow control devices 25 (a heat medium flow control device 25*a* to a heat medium flow control device 25*d*, hereinafter may be collectively referred to as the heat medium flow control devices 25) are each formed, for example, by a two-way valve capable of controlling the opening area thereof, and control the flow rate of the heat medium flowing in the corresponding pipe 5. The number of the heat medium flow control devices 25 is determined in accordance with the number of the indoor units 2 installed (which is four here). Each of the heat medium flow control devices 25 is connected at one end thereof to the corresponding use-side heat exchanger 26, and connected at the other end thereof to the corresponding first heat medium flow switching device 22. The heat medium flow control devices 25 are each located on the outlet side of the heat medium passage of the corresponding use-side heat exchanger 26. In the drawing, the heat medium flow control device 25*a*, the heat medium flow control device 25*b*, the heat medium flow control device 25*c*, and the heat medium flow control device 25*d* are arranged, in this order from the bottom of the drawing, to correspond to the respective indoor units 2. The heat medium flow control devices 25 may each be located on the inlet side of the heat medium passage of the corresponding use-side heat exchanger 26.

The heat medium relay unit 3 includes various detection means (two first temperature sensors 31, four second temperature sensors 34, four third temperature sensors 35, one fourth temperature sensor 50, and one pressure sensor 36). Information detected by these detection means (e.g., temperature information and pressure information) is sent to a controller 58 that controls the overall operation of the air-conditioning apparatus 100, and used to control the driving frequency of the compressor 10, the rotation speeds of the air-sending devices (not shown) near the heat-source-side heat exchanger 12 and the use-side heat exchangers 26, the switching of the first refrigerant flow switching device 11, the driving frequencies of the pumps 21, the switching of the second refrigerant flow switching devices 18, and the switching of the heat medium passages.

The controller 58 is formed, for example, by a microcomputer. On the basis of the refrigerant composition calculated by a computing device 52 in the heat medium relay unit 3, the controller 58 calculates an evaporation temperature, a condensing temperature, a saturation temperature, a degree of superheat, and a degree of subcooling. On the basis of these calculations, the controller 58 controls the opening degrees of the expansion devices 16, the rotation speed of the compressor 10, and the speeds (including ON/OFF) of the air-sending devices for the heat-source-side heat exchanger 12 and the use-side heat exchangers 26, so as to maximize the performance of the air-conditioning apparatus 100.

Besides, on the basis of detection information from the various detection means and instructions from a remote control, the controller 58 controls the driving frequency of the compressor 10, the rotation speeds (including ON/OFF) of the air-sending devices, the switching of the first refrigerant flow switching device 11, the drive of the pumps 21, the opening degrees of the expansion devices 16, the opening and closing of the opening and closing devices 17, the switching of the second refrigerant flow switching devices 18, the switching of the first heat medium flow switching devices 22, the switching of the second heat medium flow switching devices 23, and the opening degrees of the heat medium flow control devices 25. That is, the controller 58 controls the overall operation of various devices to execute each operation mode described below.

The controller 58 includes the computing device 52. The computing device 52 is capable of calculating a refrigerant composition. The computing device 52 includes a ROM, which stores a physical property table that shows, for each refrigerant composition value, a correlation between a liquid enthalpy and a refrigerant temperature, a correlation between a saturated liquid enthalpy and a refrigerant temperature, and a correlation between a saturated gas enthalpy and a refrigerant temperature.

The physical property tables in the computing device 52 can be reset, for example, after installation of the air-conditioning apparatus 100. Although the physical property tables showing the above-described correlations have been described as being stored in the ROM of the computing device 52, formulated functions instead of tables may be stored in the ROM. A mechanism for detecting an evaporating temperature and a dew-point temperature will be described in detail later on.

The outdoor unit 1 also includes the controller 57. In accordance with the information transmitted from the controller 58, the controller 57 controls the actuators included in the outdoor unit 1. Although the controller 58 has been described as being separate from the controller 57, the controller 58 and the controller 57 may be formed as a single unit.

Although the computing device 52 is included in the controller 58 of the heat medium relay unit 3 in Embodiment described above, the computing device 52 may be included in the controller 57 of the outdoor unit 1 to perform various computations and control the actuators.

The two first temperature sensors 31 (a first temperature sensor 31*a* and a first temperature sensor 31*b*, hereinafter may be collectively referred to as the first temperature sensors 31) each detect the temperature of the heat medium flowing out of the corresponding intermediate heat exchanger 15, that is, the temperature of the heat medium at the outlet of the intermediate heat exchanger 15. The first temperature sensors 31 may each be formed, for example, by a thermistor. The first temperature sensor 31*a* is provided in the pipe 5 on the inlet side of the pump 21*a*. The first temperature sensor 31*b* is provided in the pipe 5 on the inlet side of the pump 21*b*.

The four second temperature sensors 34 (a second temperature sensor 34*a* to a second temperature sensor 34*d*, hereinafter may be collectively referred to as the second temperature sensors 34) are each provided between the corresponding first heat medium flow switching device 22 and the corresponding heat medium flow control device 25, and detect the temperature of the heat medium flowing out of the corresponding use-side heat exchanger 26. The second temperature sensors 34 may each be formed, for example, by a thermistor. The number of the second temperature sensors 34 is determined in accordance with the number of the indoor units 2 installed (which is four here). In the drawing, the second temperature sensor 34*a*, the second temperature sensor 34*b*, the second temperature sensor 34*c*, and the second temperature sensor 34*d* are arranged, in this order from the bottom of the drawing, to correspond to the respective indoor units 2.

The four third temperature sensors 35 (a third temperature sensor 35*a* to a third temperature sensor 35*d*, hereinafter may be collectively referred to as the third temperature sensors 35) are each provided on the inlet or outlet side of the corresponding intermediate heat exchanger 15 through which the heat-source-side refrigerant passes. The third temperature sensors 35 each detect the temperature of the heat-source-side refrigerant flowing into the corresponding intermediate heat exchanger 15 or the temperature of the heat-source-side refrigerant flowing out of the corresponding intermediate heat exchanger 15. The third temperature sensors 35 may each be formed, for example, by a thermistor. The third temperature sensor 35*a* is provided between the intermediate heat exchanger 15*a* and the second refrigerant flow switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow switching device 18*b*. The third temperature sensor 35*d* is provided between the intermediate heat exchanger 15*b* and the expansion device 16*b*.

The fourth temperature sensor 50 obtains temperature information used to calculate an evaporating temperature and a dew-point temperature. The fourth temperature sensor 50 is provided between the expansion device 16*a* and the expansion device 16*b*. The fourth temperature sensor 50 may be formed, for example, by a thermistor.

Like the third temperature sensor 35*d*, the pressure sensor 36 is provided between the intermediate heat exchanger 15*b* and the expansion device 16*b*. The pressure sensor 36 detects the pressure of the heat-source-side refrigerant flowing between the intermediate heat exchanger 15*b* and the expansion device 16*b*.

The pipes 5 for circulating the heat medium are each connected to either the intermediate heat exchanger 15*a* or the intermediate heat exchanger 15*b*. The pipes 5 are divided into branches (four branches each here) in accordance with the number of the indoor units 2 connected to the heat medium relay unit 3. The pipes 5 are connected by the first heat medium flow switching devices 22 and the second heat medium flow switching devices 23. Controlling the first heat medium flow switching devices 22 and the second heat medium flow switching devices 23 determines whether to allow the heat medium from the intermediate heat exchanger 15*a* to flow into the use-side heat exchangers 26 and whether to allow the heat medium from the intermediate heat exchanger 15*b* to flow into the use-side heat exchangers 26.

[Mechanism for Detecting Evaporating Temperature and Dew-Point Temperature]

Various physical quantities calculated by the computing device 52 will now be described.

As will be described in detail later on, the present invention has the following four operation modes: the cooling only operation mode, the cooling main operation mode, the heating main operation mode, and the heating only operation mode. Because of the resulting changes in the flow of the refrigerant, the location of the same temperature sensor switches between the upstream and downstream sides of the expansion device (the expansion device 16*a* or the expansion device 16*b*) depending on the flow of the refrigerant.

The computing device 52 can calculate a liquid enthalpy (inlet liquid enthalpy) of the refrigerant flowing into the expansion device 16*b* on the basis of a physical property table and a detection result of the fourth temperature sensor 50 that detects the temperature on the inlet side of the expansion device 16*b* (in the cooling only operation mode), or a detection result of the third temperature sensor 35*d* that detects the temperature on the outlet side of the expansion device 16*b* (in the cooling main operation mode, the heating main operation mode, and the heating only operation mode).

On the basis of the physical property table and the detection result of the fourth temperature sensor 50 (in the cooling main operation mode, the heating main operation mode, and the heating only operation mode) or the third temperature sensor 35*d* (in the cooling only operation mode), the computing device 52 calculates a saturated liquid enthalpy and a saturated gas enthalpy of the refrigerant flowing out of the expansion device 16*b*.

Although an exact refrigerant composition value is not yet known when the computing device 52 calculates the saturated liquid enthalpy and the saturated gas enthalpy, the computing device 52 sets a tentative refrigerant composition value and calculates them. That is, the computing device 52 calculates the inlet liquid enthalpy on the basis of a physical property table corresponding to the set refrigerant composition value and the detection result of the fourth temperature sensor 50 (in the cooling only operation mode) or the third temperature sensor 35*d* (in the cooling main operation mode, the heating main operation mode, and the heating only operation mode), and calculates the saturated liquid enthalpy and the saturated gas enthalpy on the basis of the physical property table and the detection result of the fourth temperature sensor 50 (in the cooling main operation mode, the heating main operation mode, and the heating only operation mode) or the third temperature sensor 35*d* (in the cooling only operation mode). Thus, even when an exact refrigerant composition value is not yet known, the air-conditioning apparatus 100 can calculate an evaporating temperature and a dew-point temperature with high accuracy.

The computing device 52 can calculate a quality on the basis of the calculated inlet liquid enthalpy, saturated liquid enthalpy, and saturated gas enthalpy. The quality is calculated using the following Equation 1:

$$Xr=(Hin-Hls)/(Hgs-Hls) \quad \text{[Equation 1]}$$

Figure 7:
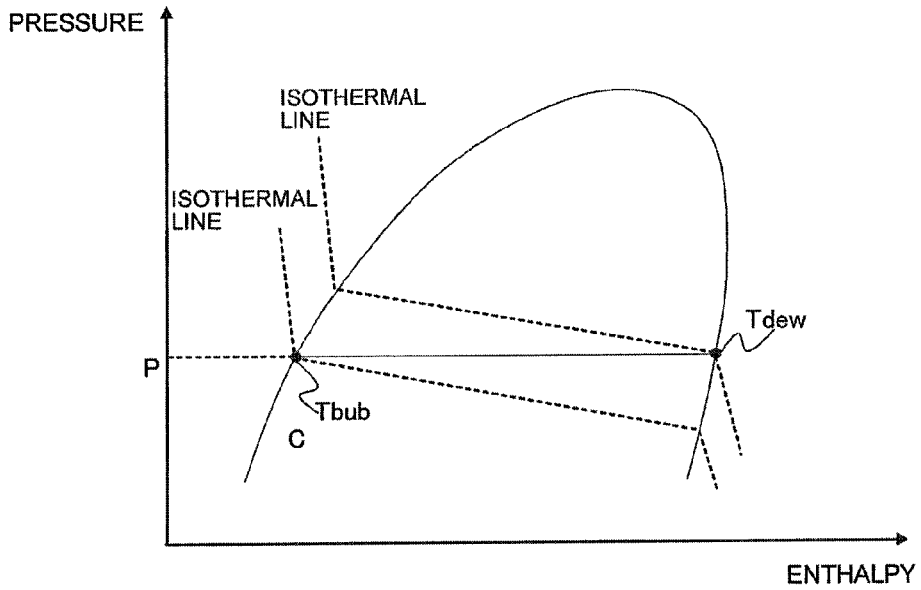
FIG. 7 illustrates a definition of a temperature glide ΔT.

The computing device 52 calculates an evaporating temperature on the basis of the quality and a temperature glide. The evaporating temperature is calculated using the following Equation 2. A temperature glide ΔT in the present invention is, as illustrated in FIG. 7, a difference between a dew-point temperature Tdew and a boiling temperature Tbub at a predetermined pressure P. A detection result of an outlet temperature sensor is denoted by TH2. FIG. 7 illustrates a definition of the temperature glide ΔT. In FIG. 7, the horizontal axis represents enthalpy, and the vertical axis represents pressure:

$$Te^*=TH2+\Delta T\times(0.5-Xr) \quad \text{[Equation 2]}$$

The computing device 52 calculates a dew-point temperature on the basis of the quality and the temperature glide. The dew-point temperature is calculated using the following Equation 3:

$$Tdew^*=TH2+\Delta T\times(1.0-Xr) \quad \text{[Equation 3]}$$

[Operation Modes]

The air-conditioning apparatus 100 includes the compressor 10, the first refrigerant flow switching device 11, the heat-source-side heat exchanger 12, the opening and closing devices 17, the second refrigerant flow switching devices 18, the refrigerant passages of the intermediate heat exchangers 15, the expansion devices 16, and the accumulator 19 that are connected by the refrigerant pipes 4 to form the refrigerant circuit A. The air-conditioning apparatus 100 also includes the heat medium passages of the intermediate heat exchangers 15, the pumps 21, the first heat medium flow switching devices 22, the heat medium flow control devices 25, the use-side heat exchangers 26, and the second heat medium flow switching devices 23 that are connected by the pipes 5 to form the heat medium circuit B. That is, a plurality of use-side heat exchangers 26 are connected in parallel to each of the intermediate heat exchangers 15 to form the heat medium circuit B composed of multiple systems.

In the air-conditioning apparatus 100, the outdoor unit 1 and the heat medium relay unit 3 are connected via the intermediate heat exchanger 15*a* and the intermediate heat exchanger 15*b* included in the heat medium relay unit 3, and the heat medium relay unit 3 and the indoor units 2 are also connected via the intermediate heat exchanger 15*a* and the intermediate heat exchanger 15*b*. That is, in the air-conditioning apparatus 100, the intermediate heat exchanger 15*a* and the intermediate heat exchanger 15*b* allow heat exchange between the heat-source-side refrigerant circulating in the refrigerant circuit A and the heat medium circulating in the heat medium circuit B.

Each operation mode performed by the air-conditioning apparatus 100 will now be described. In accordance with an instruction from each indoor unit 2, the air-conditioning apparatus 100 performs a cooling operation or a heating operation in the indoor unit 2. That is, the air-conditioning apparatus 100 can perform either the same operation in all the indoor units 2 or a different operation in each indoor unit 2.

The operation modes performed by the air-conditioning apparatus 100 include the cooling only operation mode where all indoor units 2 in operation perform a cooling operation, the heating only operation mode where all indoor units 2 in operation perform a heating operation, the cooling main operation mode which is a cooling and heating mixed operation mode where a cooling load is greater, and the heating main operation mode which is a cooling and heating mixed operation mode where a heating load is greater. Each operation mode will now be described together with the flows of the heat-source-side refrigerant and the heat medium.

[Cooling Only Operation Mode]

Figure 3:
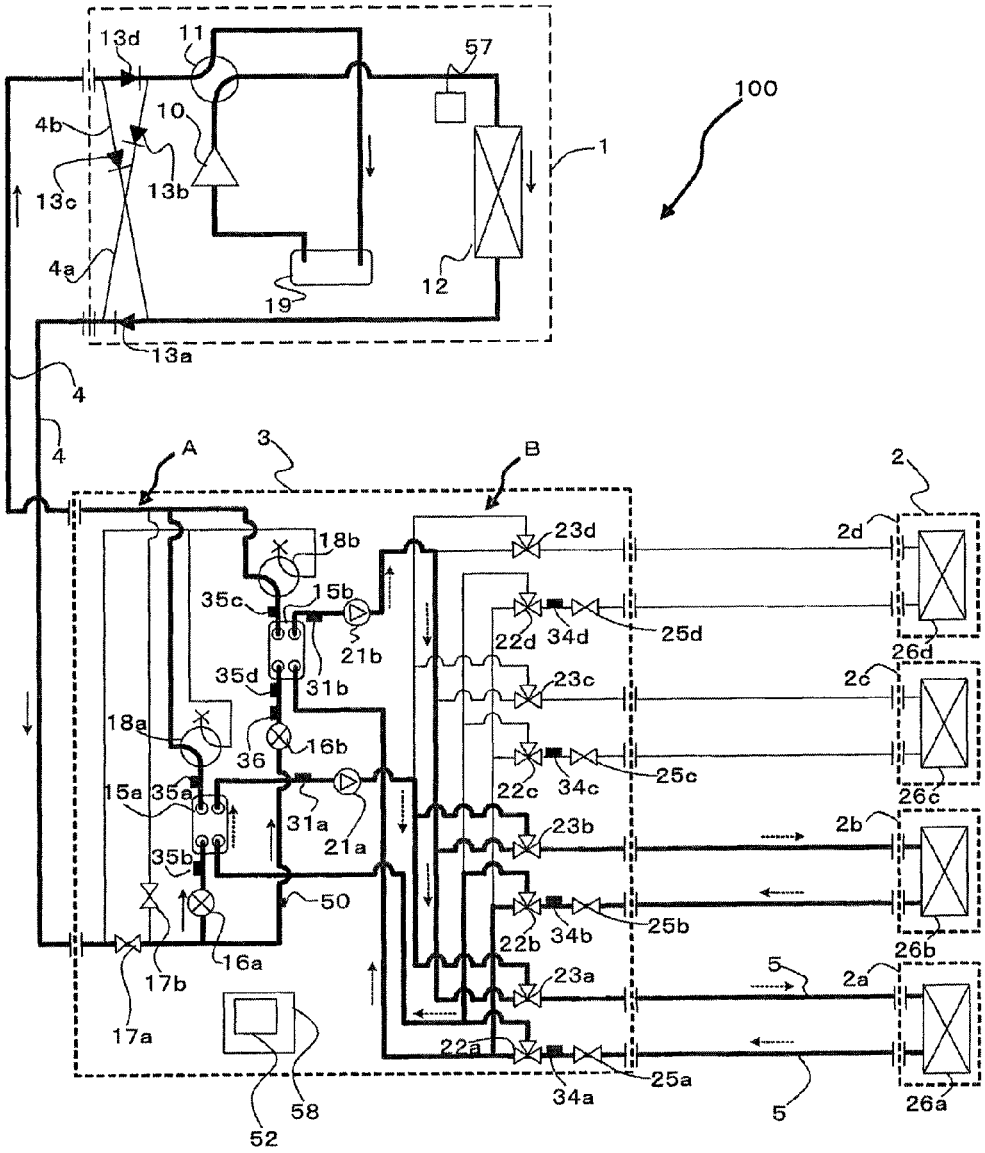
FIG. 3 is a refrigerant circuit diagram illustrating flows of refrigerants in a cooling only operation mode of the air-conditioning apparatus according to Embodiment of the present invention illustrated in FIG. 2.

FIG. 3 is a refrigerant circuit diagram illustrating flows of refrigerants in the cooling only operation mode of the air-conditioning apparatus 100 illustrated in FIG. 2. FIG. 3 illustrates the cooling only operation mode using an example where a cooling load is generated only in the use-side heat exchanger 26*a* and the use-side heat exchanger 26*b*. In FIG. 3, pipes indicated by thick lines are those through which the refrigerants (the heat-source-side refrigerant and the heat medium) flow. Also in FIG. 3, the direction of flow of the heat-source-side refrigerant is indicated by solid arrows, and the direction of flow of the heat medium is indicated by dashed arrows.

In the cooling only operation mode illustrated in FIG. 3, the outdoor unit 1 switches the first refrigerant flow switching device 11 such that the heat-source-side refrigerant discharged from the compressor 10 flows into the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between each of the intermediate heat exchanger 15*a* and the intermediate heat exchanger 15*b* and the corresponding one of the use-side heat exchanger 26*a* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11, flows into the heat-source-side heat exchanger 12, and turns into a high-pressure liquid refrigerant while transferring heat to the outdoor air in the heat-source-side heat exchanger 12. After flowing out of the heat-source-side heat exchanger 12, the high-pressure refrigerant passes through the check valve 13*a*, flows out of the outdoor unit 1, passes through the refrigerant pipe 4, and flows into the heat medium relay unit 3. After flowing into the heat medium relay unit 3 and passing through the opening and closing device 17*a*, the high-pressure refrigerant is divided and flows into the expansion device 16*a* and the expansion devices 16. The high-pressure refrigerant is expanded by each of the expansion device 16*a* and the expansion device 16*b* into a low-temperature low-pressure two-phase refrigerant. Note that the opening and closing device 17*b* is in a closed state.

The two-phase refrigerant flows into the intermediate heat exchanger 15*a* and the intermediate heat exchanger 15*b*, each serving as an evaporator, and turns into a low-temperature low-pressure gas refrigerant while cooling the heat medium by receiving heat from the heat medium circulating in the heat medium circuit B. The gas refrigerant flowing out of the intermediate heat exchanger 15*a* and the intermediate heat exchanger 15*b* passes through the second refrigerant flow switching device 18*a* and the second refrigerant flow switching device 18*b*, flows out of the heat medium relay unit 3, passes through the refrigerant pipe 4, and flows into the outdoor unit 1 again. After flowing into the outdoor unit 1, the refrigerant passes through the check valve 13*d*, the first refrigerant flow switching device 11, and the accumulator 19, and is sucked into the compressor 10 again.

The second refrigerant flow switching device 18*a* and the second refrigerant flow switching device 18*b* communicate with low-pressure side pipes. The opening degree of the expansion device 16*a* is controlled such that a degree of superheat, which is obtained as a difference between a temperature detected by the third temperature sensor 35*a* and a temperature detected by the third temperature sensor 35*b*, is constant. Similarly, the opening degree of the expansion device 16*b* is controlled such that a degree of superheat, which is obtained as a difference between a temperature detected by the third temperature sensor 35*c* and a temperature detected by the third temperature sensor 35*d*, is constant.

Next, the flow of the heat medium in the heat medium circuit B will be described.

In the cooling only operation mode, both the intermediate heat exchanger 15*a* and the intermediate heat exchanger 15*b* transfer cooling energy of the heat-source-side refrigerant to the heat medium, and the pump 21*a* and the pump 21*b* cause the cooled heat medium to flow through the pipes 5. After being pressurized by the pump 21*a* and the pump 21*b* and flowing out thereof, the heat medium passes through the second heat medium flow switching device 23*a* and the second heat medium flow switching device 23*b* and flows into the use-side heat exchanger 26*a* and the use-side heat exchanger 26*b*, where the heat medium receives heat from indoor air to cool the indoor space 7.

Then, the heat medium flows out of the use-side heat exchanger 26*a* and the use-side heat exchanger 26*b* and flows into the heat medium flow control device 25*a* and the heat medium flow control device 25*b*. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to support an air conditioning load required in the indoor space. After flowing out of the heat medium flow control device 25*a* and the heat medium flow control device 25*b*, the heat medium passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 of the use-side heat exchangers 26, the heat medium flows in the direction from the second heat medium flow switching devices 23 through the heat medium flow control devices 25 to the first heat medium flow switching devices 22. The air conditioning load required in the indoor space 7 can be supported by controlling a difference between a temperature detected by the first temperature sensor 31*a* or the first temperature sensor 31*b* and a temperature detected by the corresponding second temperature sensor 34 such that the difference is maintained as a target value. A temperature detected by one of the first temperature sensor 31*a* and the first temperature sensor 31*b*, or an average of temperatures detected by the two may be used as an outlet temperature of the intermediate heat exchangers 15. The opening degrees of the first heat medium flow switching devices 22 and the second heat medium flow switching devices 23 are set to a medium level so that passages to both the intermediate heat exchanger 15*a* and the intermediate heat exchanger 15*b* are secured.

In the execution of the cooling only operation mode, since it is not necessary to supply the heat medium to any use-side heat exchanger 26 having no heat load (including thermo-off), the corresponding heat medium flow control device 25 closes the passage to prevent the heat medium from flowing into the use-side heat exchanger 26. In FIG. 3, the heat medium is supplied to the use-side heat exchanger 26*a* and the use-side heat exchanger 26*b* because they have a heat load. The use-side heat exchanger 26*c* and the use-side heat exchanger 26*d* have no heat load, and the corresponding heat medium flow control device 25*c* and heat medium flow control device 25*d* are fully closed. When a heat load is generated in the use-side heat exchanger 26*c* or the use-side heat exchanger 26*d*, the heat medium flow control device 25*c* or the heat medium flow control device 25*d* may be opened to allow the heat medium to circulate.

In the cooling only operation mode, the refrigerant at the location of the fourth temperature sensor 50 is a liquid refrigerant. The computing device 52 calculates the inlet liquid enthalpy on the basis of temperature information from the fourth temperature sensor 50. In the cooling only operation mode, the third temperature sensor 35*d* detects the temperature of the refrigerant in a low-pressure two-phase state. On the basis of this temperature information, the computing device 52 calculates the saturated liquid enthalpy and the saturated gas enthalpy. On the basis of the information described above, an evaporating temperature Te* and a dew-point temperature Tdew* are determined by a method described below.

[Heating Only Operation Mode]

Figure 4:
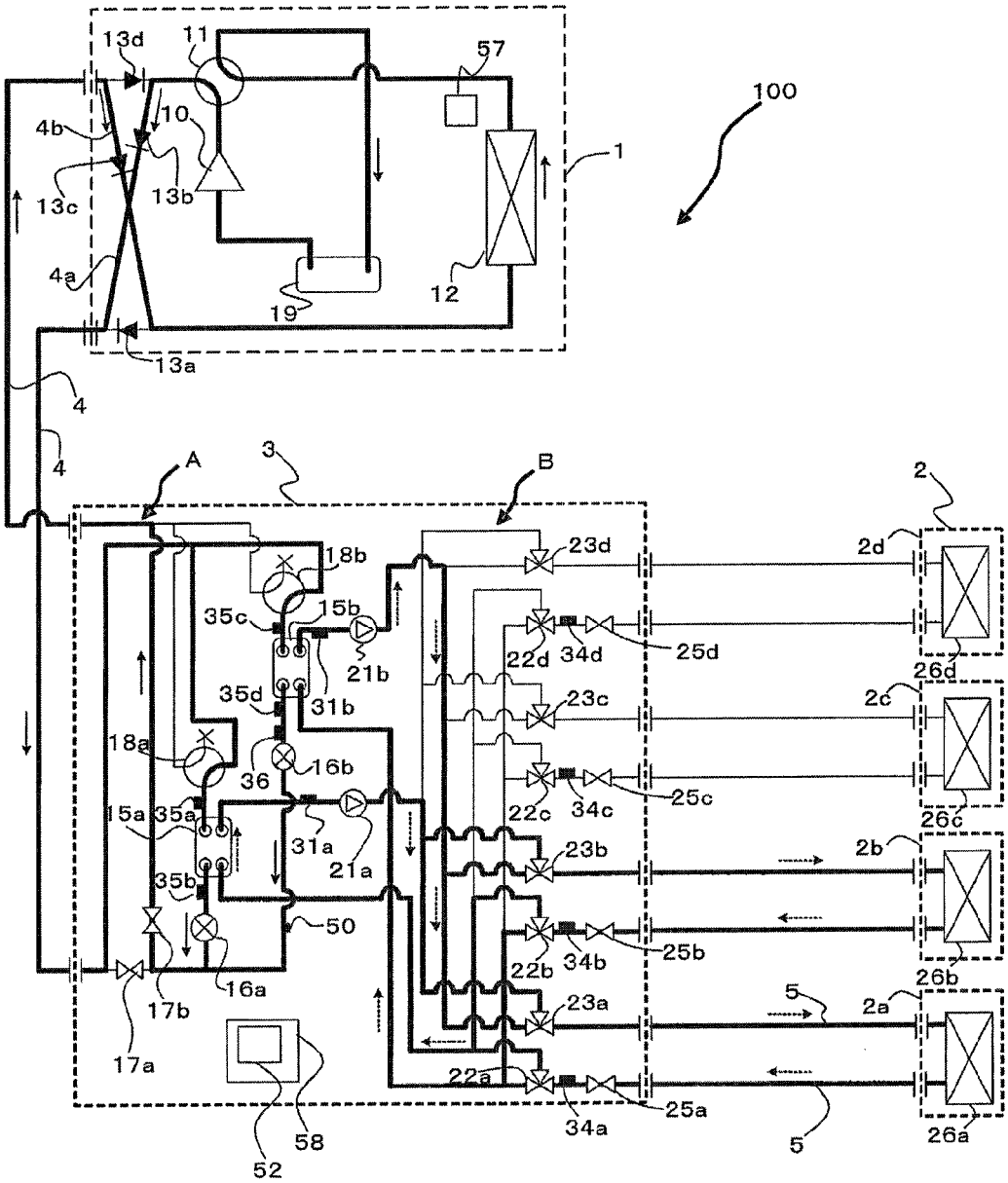
FIG. 4 is a refrigerant circuit diagram illustrating flows of refrigerants in a heating only operation mode of the air-conditioning apparatus according to Embodiment of the present invention illustrated in FIG. 2.

FIG. 4 is a refrigerant circuit diagram illustrating flows of refrigerants in the heating only operation mode of the air-conditioning apparatus 100 illustrated in FIG. 2. FIG. 4 illustrates the heating only operation mode using an example where a heating load is generated only in the use-side heat exchanger 26*a* and the use-side heat exchanger 26*b*. In FIG. 4, pipes indicated by thick lines are those through which the refrigerants (the heat-source-side refrigerant and the heat medium) flow. Also in FIG. 4, the direction of flow of the heat-source-side refrigerant is indicated by solid arrows, and the direction of flow of the heat medium is indicated by dashed arrows.

In the heating only operation mode illustrated in FIG. 4, the outdoor unit 1 switches the first refrigerant flow switching device 11 such that the heat-source-side refrigerant discharged from the compressor 10 flows into the heat medium relay unit 3 without passing through the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between each of the intermediate heat exchanger 15*a* and the intermediate heat exchanger 15*b* and the corresponding one of the use-side heat exchanger 26*a* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11 and the check valve 13*b*, and flows out of the outdoor unit 1. The high-temperature high-pressure gas refrigerant flowing out of the outdoor unit 1 passes through the refrigerant pipe 4, and flows into the heat medium relay unit 3. After flowing into the heat medium relay unit 3, the high-temperature high-pressure gas refrigerant is divided, passes through each of the second refrigerant flow switching device 18*a* and the second refrigerant flow switching device 18*b*, and flows into each of the intermediate heat exchanger 15*a* and the intermediate heat exchanger 15*b*.

After flowing into each of the intermediate heat exchanger 15*a* and the intermediate heat exchanger 15*b*, the high-temperature high-pressure gas refrigerant condenses and liquefies into a high-pressure liquid refrigerant while transferring heat to the heat medium circulating in the heat medium circuit B. The liquid refrigerant flowing out of the intermediate heat exchanger 15*a* and the intermediate heat exchanger 15*b* is expanded by the expansion device 16*a* and the expansion device 16*b* into a low-temperature low-pressure two-phase refrigerant. The two-phase refrigerant passes through the opening and closing device 17*b*, flows out of the heat medium relay unit 3, passes through the refrigerant pipe 4, and flows into the outdoor unit 1 again. Note that the opening and closing device 17*a* is in a closed state.

After flowing into the outdoor unit 1, the refrigerant passes through the check valve 13*c* and flows into the heat-source-side heat exchanger 12 serving as an evaporator. In the heat-source-side heat exchanger 12, the refrigerant receives heat from the outdoor air and turns into a low-temperature low-pressure gas refrigerant. The low-temperature low-pressure gas refrigerant flowing out of the heat-source-side heat exchanger 12 passes through the first refrigerant flow switching device 11 and the accumulator 19, and is sucked into the compressor 10 again.

The second refrigerant flow switching device 18*a* and the second refrigerant flow switching device 18*b* communicate with high-pressure side pipes. The opening degree of the expansion device 16*a* is controlled such that a degree of subcooling, which is obtained as a difference between a saturation temperature determined by converting a pressure detected by the pressure sensor 36 and a temperature detected by the third temperature sensor 35*b*, is constant. Similarly, the opening degree of the expansion device 16*b* is controlled such that a degree of subcooling, which is obtained as a difference between a saturation temperature determined by converting a pressure detected by the pressure sensor 36 and a temperature detected by the third temperature sensor 35*d*, is constant. Note that if a temperature at an intermediate position between the intermediate heat exchangers 15 can be measured, the temperature at the intermediate position may be used instead of using the pressure sensor 36. This can reduce the cost of producing a system.

Next, the flow of the heat medium in the heat medium circuit B will be described.

In the heating only operation mode, both the intermediate heat exchanger 15*a* and the intermediate heat exchanger 15*b* transfer heating energy of the heat-source-side refrigerant to the heat medium, and the pump 21*a* and the pump 21*b* cause the heated heat medium to flow through the pipes 5. After being pressurized by the pump 21*a* and the pump 21*b* and flowing out thereof, the heat medium passes through the second heat medium flow switching device 23*a* and the second heat medium flow switching device 23*b* and flows into the use-side heat exchanger 26*a* and the use-side heat exchanger 26*b*, where the heat medium transfers heat to the indoor air to heat the indoor space 7.

Then, the heat medium flows out of the use-side heat exchanger 26*a* and the use-side heat exchanger 26*b* and flows into the heat medium flow control device 25*a* and the heat medium flow control device 25*b*. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to support an air conditioning load required in the indoor space. After flowing out of the heat medium flow control device 25*a* and the heat medium flow control device 25*b*, the heat medium passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 of the use-side heat exchangers 26, the heat medium flows in the direction from the second heat medium flow switching devices 23 through the heat medium flow control devices 25 to the first heat medium flow switching devices 22. The air conditioning load required in the indoor space 7 can be supported by controlling a difference between a temperature detected by the first temperature sensor 31*a* or the first temperature sensor 31*b* and a temperature detected by the corresponding second temperature sensor 34 such that the difference is maintained as a target value. A temperature detected by one of the first temperature sensor 31*a* and the first temperature sensor 31*b*, or an average of temperatures detected by the two may be used as an outlet temperature of the intermediate heat exchangers 15.

The opening degrees of the first heat medium flow switching devices 22 and the second heat medium flow switching devices 23 are set to a medium level so that passages to both the intermediate heat exchanger 15*a* and the intermediate heat exchanger 15*b* are secured. The use-side heat exchanger 26*a* essentially needs to be controlled in accordance with a difference between a temperature at its inlet and that at its outlet. However, since the temperature of the heat medium on the inlet side of the use-side heat exchanger 26 is substantially the same as that detected by the first temperature sensor 31*b*, using the first temperature sensor 31*b* can reduce the number of temperature sensors, so that the cost of producing the system can be reduced.

As in the case of the cooling only operation mode described above, the opening and closing of the heat medium flow control devices 25 may be controlled depending on the presence of a heat load.

In the heating only operation mode, the refrigerant at the location of the third temperature sensor 35*d* is a liquid refrigerant. The computing device 52 calculates the inlet liquid enthalpy on the basis of temperature information from the third temperature sensor 35*d*. The fourth temperature sensor 50 detects the temperature of the refrigerant in a low-pressure two-phase state. On the basis of this temperature information, the computing device 52 calculates the saturated liquid enthalpy and the saturated gas enthalpy. On the basis of the information described above, an evaporating temperature Te* and a dew-point temperature Tdew* are determined by a method described below.

[Cooling Main Operation Mode]

Figure 5:
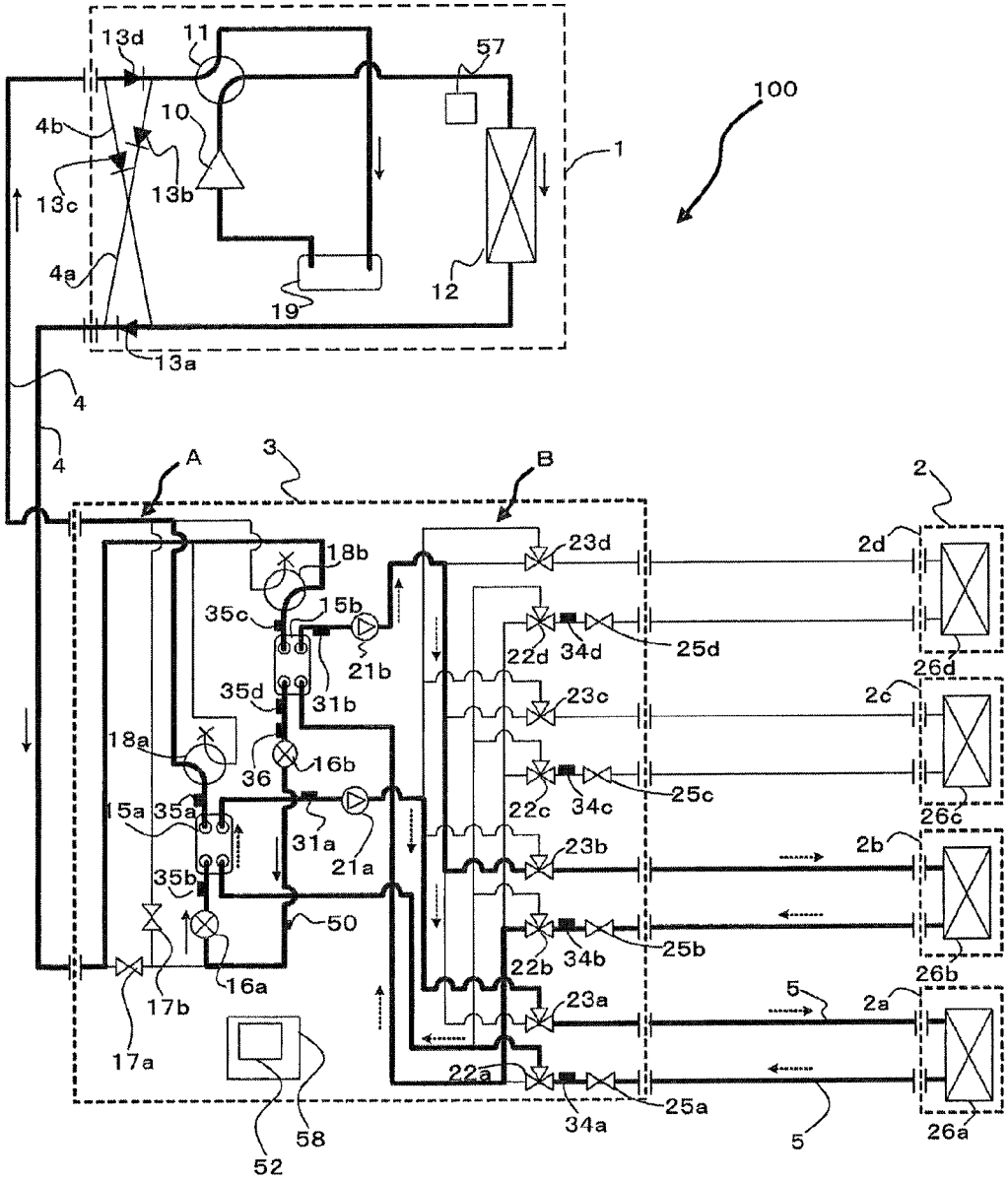
FIG. 5 is a refrigerant circuit diagram illustrating flows of refrigerants in a cooling main operation mode of the air-conditioning apparatus according to Embodiment of the present invention illustrated in FIG. 2.

FIG. 5 is a refrigerant circuit diagram illustrating flows of refrigerants in the cooling main operation mode of the air-conditioning apparatus 100 illustrated in FIG. 2. FIG. 5 illustrates the cooling main operation mode using an example where a cooling load is generated in the use-side heat exchanger 26*a* and a heating load is generated in the use-side heat exchanger 26*b*. In FIG. 5, pipes indicated by thick lines are those through which the refrigerants (the heat-source-side refrigerant and the heat medium) circulate. Also in FIG. 5, the direction of flow of the heat-source-side refrigerant is indicated by solid arrows, and the direction of flow of the heat medium is indicated by dashed arrows.

In the cooling main operation mode illustrated in FIG. 5, the outdoor unit 1 switches the first refrigerant flow switching device 11 such that the heat-source-side refrigerant discharged from the compressor 10 flows into the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between the intermediate heat exchanger 15*a* and the use-side heat exchanger 26*a* and between the intermediate heat exchanger 15*b* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11, flows into the heat-source-side heat exchanger 12, and turns into a liquid refrigerant while transferring heat to the outdoor air in the heat-source-side heat exchanger 12. After flowing out of the heat-source-side heat exchanger 12, the refrigerant flows out of the outdoor unit 1, passes through the check valve 13*a* and the refrigerant pipe 4, and flows into the heat medium relay unit 3. After flowing into the heat medium relay unit 3, the refrigerant passes through the second refrigerant flow switching device 18*b* and flows into the intermediate heat exchanger 15*b* serving as a condenser.

In the intermediate heat exchanger 15*b*, the refrigerant further lowers its temperature by transferring heat to the heat medium circulating in the heat medium circuit B. The refrigerant flowing out of the intermediate heat exchanger 15*b* is expanded by the expansion device 16*b* into a low-pressure two-phase refrigerant, which passes through the expansion device 16*a* and flows into the intermediate heat exchanger 15*a* serving as an evaporator. In the intermediate heat exchanger 15*a*, the low-pressure two-phase refrigerant receives heat from the heat medium circulating in the heat medium circuit B to cool the heat medium, and turns into a low-pressure gas refrigerant. The gas refrigerant flows out of the intermediate heat exchanger 15*a*, passes through the second refrigerant flow switching device 18*a*, flows out of the heat medium relay unit 3, passes through the refrigerant pipe 4, and flows into the outdoor unit 1 again. After flowing into the outdoor unit 1, the refrigerant passes through the check valve 13*d*, the first refrigerant flow switching device 11, and the accumulator 19, and is sucked into the compressor 10 again.

The second refrigerant flow switching device 18*a* communicates with a low-pressure side pipe, whereas the second refrigerant flow switching device 18*b* communicates with a high-pressure side pipe. The opening degree of the expansion device 16*b* is controlled such that a degree of superheat, which is obtained as a difference between a temperature detected by the third temperature sensor 35*a* and a temperature detected by the third temperature sensor 35*b*, is constant. The expansion device 16*a* is fully opened and the opening and closing device 17*a* and the opening and closing device 17*b* are closed. The opening degree of the expansion device 16*b* may be controlled such that a degree of subcooling, which is obtained as a difference between a saturation temperature determined by converting a pressure detected by the pressure sensor 36 and a temperature detected by the third temperature sensor 35*d*, is constant. The expansion device 16*b* may be fully opened, and the degree of superheat or subcooling may be controlled with the expansion device 16*a*.

Next, the flow of the heat medium in the heat medium circuit B will be described.

In the cooling main operation mode, the intermediate heat exchanger 15*b* transfers heating energy of the heat-source-side refrigerant to the heat medium, and the pump 21*b* causes the heated heat medium to flow through the pipe 5. Also in the cooling main operation mode, the intermediate heat exchanger 15*a* transfers cooling energy of the heat-source-side refrigerant to the heat medium, and the pump 21*a* causes the cooled heat medium to flow through the pipe 5. After being pressurized by the pump 21*a* and the pump 21*b* and flowing out thereof, the heat medium passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, the heat medium transfers heat to the indoor air to heat the indoor space 7. In the use-side heat exchanger 26*a*, the heat medium receives heat from the indoor air to cool the indoor space 7. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to support an air conditioning load required in the indoor space. After passing through the use-side heat exchanger 26*b* and slightly lowering its temperature, the heat medium passes through the heat medium flow control device 25*b* and the first heat medium flow switching device 22*b*, flows into the intermediate heat exchanger 15*b*, and is sucked into the pump 21*b* again. After passing through the use-side heat exchanger 26*a* and slightly increasing its temperature, the heat medium passes through the heat medium flow control device 25*a* and the first heat medium flow switching device 22*a*, flows into the intermediate heat exchanger 15*a*, and is sucked into the pump 21*a* again.

During this process, the actions of the first heat medium flow switching devices 22 and the second heat medium flow switching devices 23 allow the warm heat medium and the cool heat medium to be introduced, without being mixed together, into the respective use-side heat exchangers 26 each having either a heating load or a cooling load. In the pipes 5 of the use-side heat exchangers 26, on both the heating side and the cooling side, the heat medium flows in the direction from the second heat medium flow switching devices 23 through the heat medium flow control devices 25 to the first heat medium flow switching devices 22. The air conditioning load required in the indoor space 7 can be supported by controlling on the heating side a difference between a temperature detected by the first temperature sensor 31*b* and a temperature detected by the corresponding second temperature sensor 34 such that the difference is maintained as a target value, and by controlling on the cooling side a difference between a temperature detected by the first temperature sensor 31*a* and a temperature detected by the corresponding second temperature sensor 34 such that the difference is maintained as a target value.

As in the case of the cooling only operation mode described above, the opening and closing of the heat medium flow control devices 25 may be controlled depending on the presence of a heat load.

In the cooling main operation mode, the refrigerant at the location of the third temperature sensor 35*d* is a liquid refrigerant. The computing device 52 calculates the inlet liquid enthalpy on the basis of temperature information from the third temperature sensor 35*d*. The fourth temperature sensor 50 detects the temperature of the refrigerant in a low-pressure two-phase state. On the basis of this temperature information, the computing device 52 calculates the saturated liquid enthalpy and the saturated gas enthalpy. On the basis of the information described above, an evaporating temperature Te* and a dew-point temperature Tdew* are determined by a method described below.

[Heating Main Operation Mode]

Figure 6:
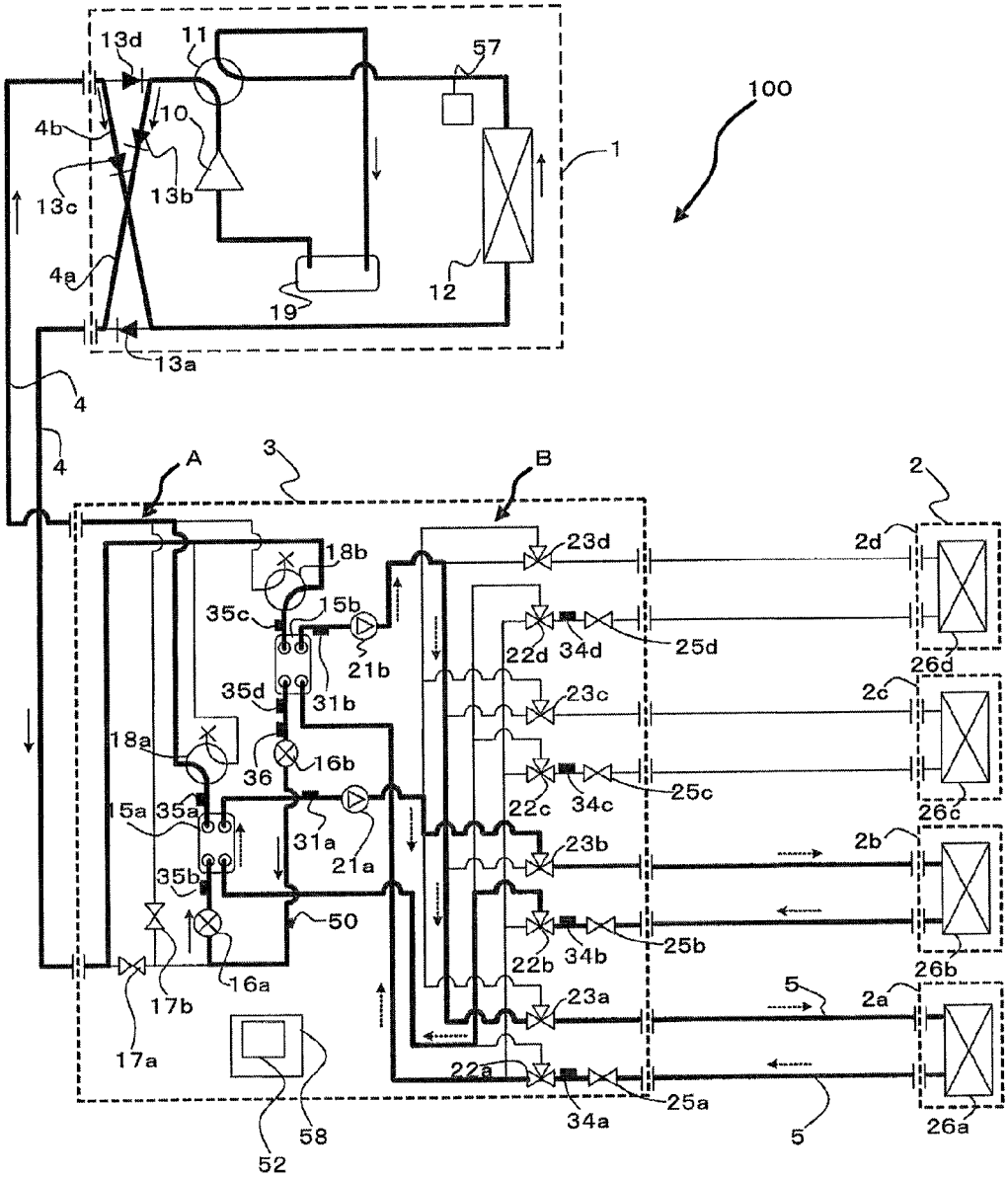
FIG. 6 is a refrigerant circuit diagram illustrating flows of refrigerants in a heating main operation mode of the air-conditioning apparatus according to Embodiment of the present invention illustrated in FIG. 2.

FIG. 6 is a refrigerant circuit diagram illustrating flows of refrigerants in the heating main operation mode of the air-conditioning apparatus 100 illustrated in FIG. 2. FIG. 6 illustrates the heating main operation mode using an example where a heating load is generated in the use-side heat exchanger 26*a* and a cooling load is generated in the use-side heat exchanger 26*b*. In FIG. 6, pipes indicated by thick lines are those through which the refrigerants (the heat-source-side refrigerant and the heat medium) circulate. Also in FIG. 6, the direction of flow of the heat-source-side refrigerant is indicated by solid arrows, and the direction of flow of the heat medium is indicated by dashed arrows.

In the heating main operation mode illustrated in FIG. 6, the outdoor unit 1 switches the first refrigerant flow switching device 11 such that the heat-source-side refrigerant discharged from the compressor 10 flows into the heat medium relay unit 3 without passing through the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between the intermediate heat exchanger 15*a* and the use-side heat exchanger 26*b* and between the intermediate heat exchanger 15*b* and the use-side heat exchanger 26*a*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11 and the check valve 13*b*, and flows out of the outdoor unit 1. The high-temperature high-pressure gas refrigerant flowing out of the outdoor unit 1 passes through the refrigerant pipe 4, and flows into the heat medium relay unit 3. After flowing into the heat medium relay unit 3, the high-temperature high-pressure gas refrigerant passes through the second refrigerant flow switching device 18*b* and flows into the intermediate heat exchanger 15*b* serving as a condenser.

In the intermediate heat exchanger 15*b*, the gas refrigerant turns into a liquid refrigerant while transferring heat to the heat medium circulating in the heat medium circuit B. The refrigerant flowing out of the intermediate heat exchanger 15*b* is expanded by the expansion device 16*b* into a low-pressure two-phase refrigerant. The low-pressure two-phase refrigerant passes through the expansion device 16*a* and flows into the intermediate heat exchanger 15*a* serving as an evaporator. In the intermediate heat exchanger 15*a*, the low-pressure two-phase refrigerant evaporates by receiving heat from the heat medium circulating in the heat medium circuit B, and cools the heat medium. The low-pressure two-phase refrigerant flows out of the intermediate heat exchanger 15*a*, passes through the second refrigerant flow switching device 18*a*, flows out of the heat medium relay unit 3, and flows into the outdoor unit 1 again.

After flowing into the outdoor unit 1, the refrigerant passes through the check valve 13*c* and flows into the heat-source-side heat exchanger 12 serving as an evaporator. In the heat-source-side heat exchanger 12, the refrigerant receives heat from the outdoor air and turns into a low-temperature low-pressure gas refrigerant. The low-temperature low-pressure gas refrigerant flowing out of the heat-source-side heat exchanger 12 passes through the first refrigerant flow switching device 11 and the accumulator 19, and is sucked into the compressor 10 again.

The second refrigerant flow switching device 18*a* communicates with a low-pressure side pipe, whereas the second refrigerant flow switching device 18*b* communicates with a high-pressure side pipe. The opening degree of the expansion device 16*b* is controlled such that a degree of subcooling, which is obtained as a difference between a saturation temperature determined by converting a pressure detected by the pressure sensor 36 and a temperature detected by the third temperature sensor 35*b*, is constant. The expansion device 16*a* is fully opened, and the opening and closing device 17*a* and the opening and closing device 17*b* are closed. The expansion device 16*b* may be fully opened, and the degree of subcooling may be controlled with the expansion device 16*a*.

Next, the flow of the heat medium in the heat medium circuit B will be described.

In the heating main operation mode, the intermediate heat exchanger 15*b* transfers heating energy of the heat-source-side refrigerant to the heat medium, and the pump 21*b* causes the heated heat medium to flow through the pipe 5. Also in the heating main operation mode, the intermediate heat exchanger 15*a* transfers cooling energy of the heat-source-side refrigerant to the heat medium, and the pump 21*a* causes the cooled heat medium to flow through the pipe 5. After being pressurized by the pump 21*a* and the pump 21*b* and flowing out thereof, the heat medium passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, the heat medium receives heat from the indoor air to cool the indoor space 7. In the use-side heat exchanger 26*a*, the heat medium transfers heat to the indoor air to heat the indoor space 7. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to support an air conditioning load required in the indoor space. After passing through the use-side heat exchanger 26*b* and slightly increasing its temperature, the heat medium passes through the heat medium flow control device 25*b* and the first heat medium flow switching device 22*b*, flows into the intermediate heat exchanger 15*a*, and is sucked into the pump 21*a* again. After passing through the use-side heat exchanger 26*a* and slightly lowering its temperature, the heat medium passes through the heat medium flow control device 25*a* and the first heat medium flow switching device 22*a*, flows into the intermediate heat exchanger 15*b*, and is sucked into the pump 21*b* again.

During this process, the actions of the first heat medium flow switching devices 22 and the second heat medium flow switching devices 23 allow the warm heat medium and the cool heat medium to be introduced, without being mixed together, into the respective use-side heat exchangers 26 each having either a heating load or a cooling load. In the pipes 5 of the use-side heat exchangers 26, on both the heating side and the cooling side, the heat medium flows in the direction from the second heat medium flow switching devices 23 through the heat medium flow control devices 25 to the first heat medium flow switching devices 22. The air conditioning load required in the indoor space 7 can be supported by controlling on the heating side a difference between a temperature detected by the first temperature sensor 31*b* and a temperature detected by the corresponding second temperature sensor 34 such that the difference is maintained as a target value, and by controlling on the cooling side a difference between a temperature detected by the first temperature sensor 31*a* and a temperature detected by the corresponding second temperature sensor 34 such that the difference is maintained as a target value.

As in the case of the cooling only operation mode described above, the opening and closing of the heat medium flow control devices 25 may be controlled depending on the presence of a heat load.

In the heating main operation mode, the refrigerant at the location of the third temperature sensor 35*d* is a liquid refrigerant. The computing device 52 calculates the inlet liquid enthalpy on the basis of temperature information from the third temperature sensor 35*d*. The fourth temperature sensor 50 detects the temperature of the refrigerant in a low-pressure two-phase state. On the basis of this temperature information, the computing device 52 calculates the saturated liquid enthalpy and the saturated gas enthalpy. On the basis of the information described above, an evaporating temperature Te* and a dew-point temperature Tdew* are determined by a method described below.

[Refrigerant Pipes 4]

As described above, the air-conditioning apparatus 100 according to Embodiment has several operation modes, where the heat-source-side refrigerant flows through the refrigerant pipes 4 that connect the outdoor unit 1 and the heat medium relay unit 3.

[Pipes 5]

In the several operation modes performed by the air-conditioning apparatus 100 according to Embodiment, the heat medium, such as water or antifreeze, flows through the pipes 5 that connect the heat medium relay unit 3 and the indoor units 2.

[Heat-Source-Side Refrigerant]

Embodiment has dealt with an example where a mixture of R32 and HFO1234yf is used as the heat-source-side refrigerant. Even in the case of another two-component non-azeotropic refrigerant mixture, using a refrigerant composition control flow (described below) according to Embodiment makes it possible to calculate an evaporating temperature and a dew-point temperature with high accuracy.

[Heat Medium]

Examples of the heat medium that can be used include brine (antifreeze), water, a mixed solution of brine and water, and a mixed solution of water and an anti-corrosive additive. Thus, in the air-conditioning apparatus 100, even if the heat medium leaks through any indoor unit 2 into the indoor space 7, since the heat medium is safe, it is possible to contribute to improved safety.

If the state (heating or cooling) of each of the intermediate heat exchanger 15*b* and the intermediate heat exchanger 15*a* changes in the cooling main operation mode and the heating main operation mode, warm water is cooled to a lower temperature and cool water is heated to a higher temperature, and this results in waste of energy. Therefore, the air-conditioning apparatus 100 is configured such that in both the cooling main operation mode and the heating main operation mode, the intermediate heat exchanger 15*b* is always on the heating side and the intermediate heat exchanger 15*a* is always on the cooling side.

When both a heating load and a cooling load are generated in the use-side heat exchangers 26, the first heat medium flow switching device 22 and the second heat medium flow switching device 23 corresponding to a use-side heat exchanger 26 in the heating operation are switched to passages connected to the intermediate heat exchanger 15*b* designed for heating, and the first heat medium flow switching device 22 and the second heat medium flow switching device 23 corresponding to a use-side heat exchanger 26 in the cooling operation are switched to passages connected to the intermediate heat exchanger 15*a* designed for cooling. This allows each indoor unit 2 to freely perform both the heating operation and the cooling operation.

Although the air-conditioning apparatus 100 has been described as being capable of performing a cooling and heating mixed operation, the air-conditioning apparatus 100 is not limited to this. For example, the same effect can be achieved even if the air-conditioning apparatus 100 includes one intermediate heat exchanger 15 and one expansion device 16 to which a plurality of heat medium flow control devices 25 and a plurality of use-side heat exchangers 26 are connected in parallel, so that the air-conditioning apparatus 100 can perform only one of the heating operation and the cooling operation.

The same applies to the case where only one use-side heat exchanger 26 and only one heat medium flow control device 25 are connected. The intermediate heat exchangers 15 and the expansion devices 16 may be replaced by a plurality of components having the same functions as those of the intermediate heat exchangers 15 and the expansion devices 16. Although the heat medium flow control devices 25 are included in the heat medium relay unit 3 in the example described above, the configuration is not limited to this. Each heat medium flow control device 25 may be included in the indoor unit 2, or may be configured as a unit separate from both the heat medium relay unit 3 and the indoor unit 2.

Although the heat-source-side heat exchanger 12 and each of the use-side heat exchangers 26 are each typically provided with an air-sending device which sends air to promote condensation or evaporation, the configuration is not limited to this. For example, a panel heater that uses radiation may be used as the use-side heat exchanger 26, and a water-cooled heat exchanger that transfers heat through water or antifreeze may be used as the heat-source-side heat exchanger 12. That is, the heat-source-side heat exchanger 12 and the use-side heat exchanger 26 may be of any types, as long as they are configured to be capable of transferring or receiving heat.

[Method for Calculating Evaporating Temperature and Dew-Point Temperature]

A method for calculating an evaporating temperature and a dew-point temperature performed by the air-conditioning apparatus 100 will now be described in detail. The air-conditioning apparatus 100 has four operation modes as described above. The following description will describe the cooling only operation mode as an example.

Figure 8:
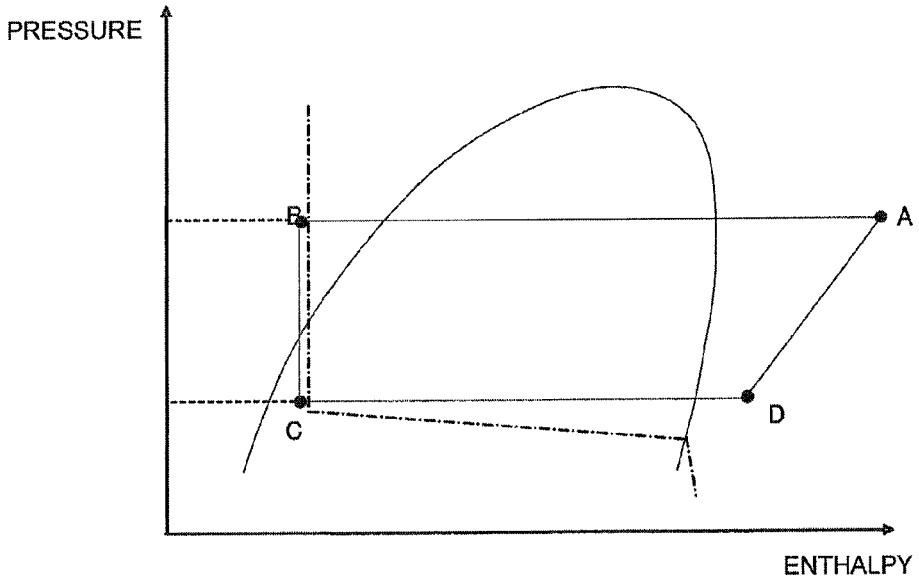
FIG. 8 is a p-h diagram showing state transition of a refrigerant in the cooling only operation mode of the air-conditioning apparatus according to Embodiment of the present invention.
Figure 9:
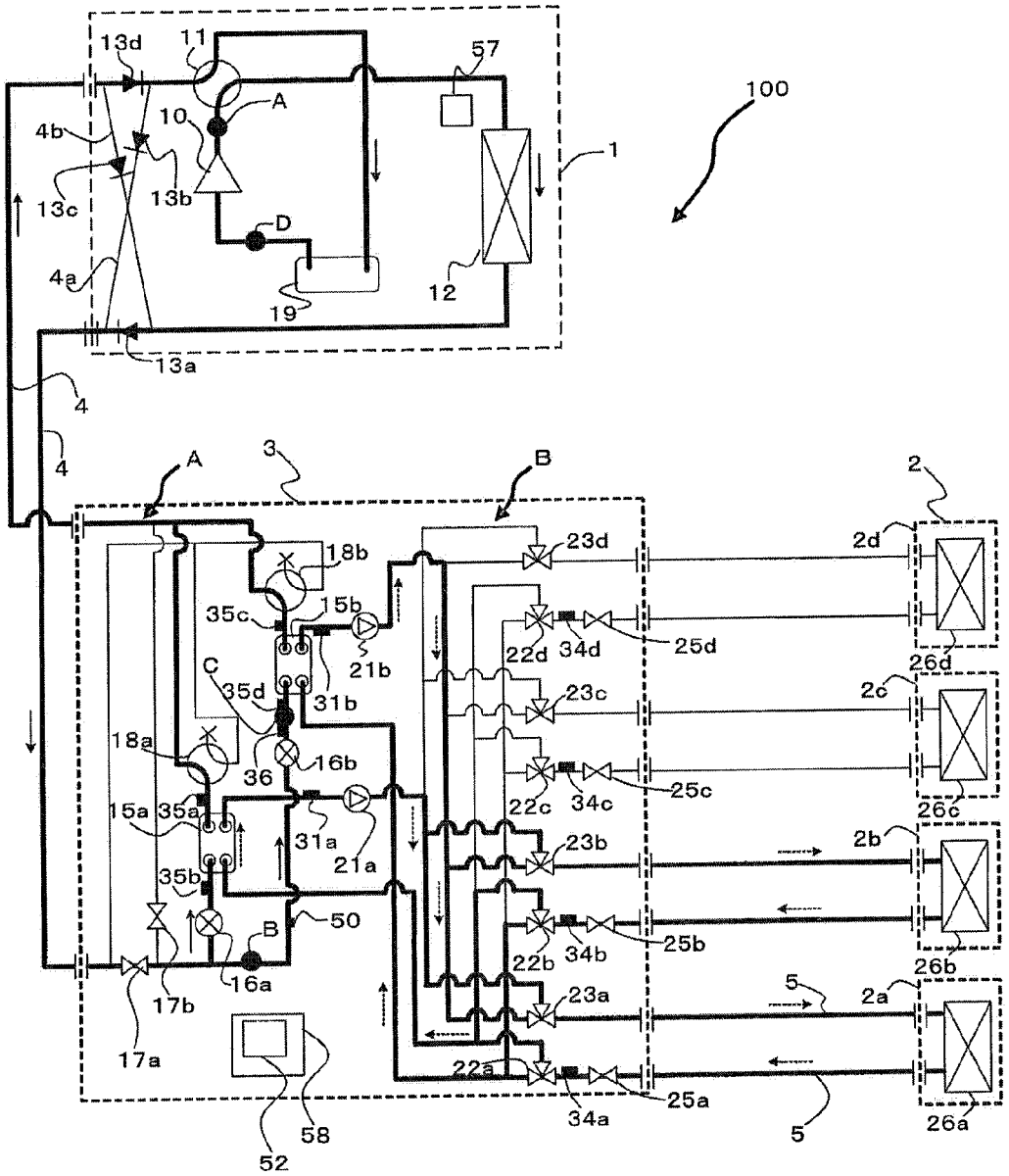
FIG. 9 is a refrigerant circuit diagram on which points corresponding to points A to D shown in FIG. 8 are plotted.
Figure 10:
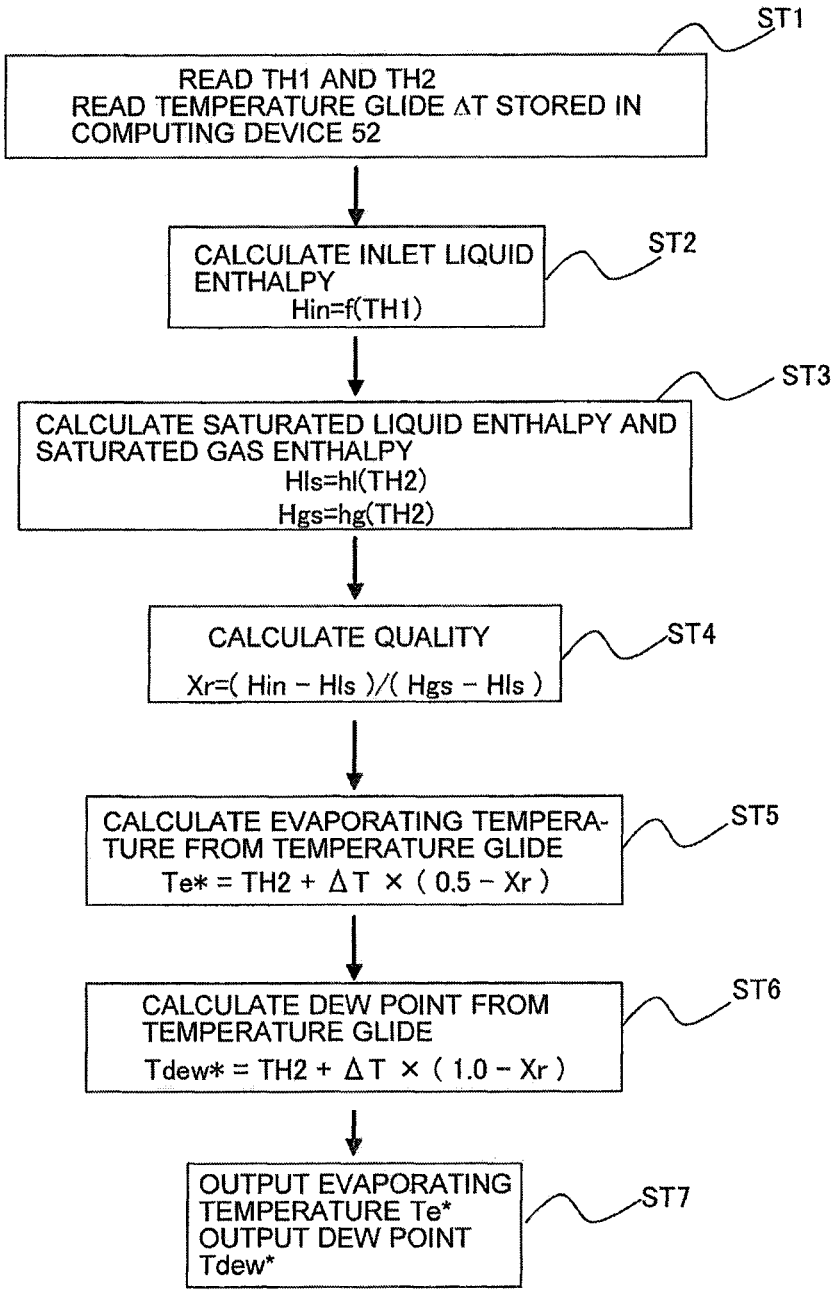
FIG. 10 is a flowchart illustrating a process of detection for calculating an evaporating temperature and a dew-point temperature adopted in the air-conditioning apparatus according to Embodiment of the present invention.

FIG. 8 is a P-H diagram showing state transition of a refrigerant in the cooling only operation mode. FIG. 9 is a refrigerant circuit diagram on which points corresponding to points A to D shown in FIG. 8 are plotted. FIG. 10 is a flowchart illustrating a process of detection for calculating an evaporating temperature and a dew-point temperature in the air-conditioning apparatus 100. A method for calculating an evaporating temperature and a dew-point temperature performed by the air-conditioning apparatus 100 will be described with reference to FIGS. 8 to 10.

Note that points A to D shown in FIG. 8 are operating points on the P-H diagram and correspond to points A to D shown in FIG. 9. Point A represents a discharge portion of the compressor 10, and the refrigerant is in a high-temperature high-pressure gas state at point A. Point B represents a position upstream of the expansion device 16*b*, and the refrigerant is in a low-temperature high-pressure liquid state at point B. Point C represents a position downstream of the expansion device 16*b*, and the refrigerant is in a low-temperature two-phase gas-liquid state at point C. Point D represents a suction portion of the compressor 10, and the refrigerant is in a low-temperature low-pressure gas state at point D.

The control flow of the computing device 52 will be described with reference to FIG. 10.

(Step ST1)

The computing device 52 reads a detection result (TH1) of an inlet temperature sensor (fourth temperature sensor 50) and a detection result (TH2) of an outlet temperature sensor (third temperature sensor 35*d*). Then, the computing device 52 proceeds to step ST2.

In the cooling main operation mode, the heating main operation mode, and the heating only operation mode, the inlet and outlet temperature sensors are reversed. That is, the third temperature sensor 35*d* serves as the inlet temperature sensor, and the fourth temperature sensor 50 serves as the outlet temperature sensor. The inlet temperature sensor corresponds to inlet temperature detection means of the present invention, and the outlet temperature sensor corresponds to outlet temperature detection means of the present invention.

(Step ST2)

The computing device 52 tentatively sets a circulating refrigerant composition value. From the detected temperature (TH1) of the inlet temperature sensor, the computing device 52 calculates, on the basis of a physical property table, an enthalpy Hin (inlet liquid enthalpy) of the refrigerant flowing into the expansion device 16*b*. Then, the computing device 52 proceeds to step ST3.

In Embodiment, the set circulating refrigerant composition refers to a composition ratio of the non-azeotropic refrigerant mixture charged in the air-conditioning apparatus 100. For example, a refrigerant composition that most frequently occurs may be determined by an experiment in advance and set as the circulating refrigerant composition.

(Step ST3)

From the detected temperature (TH2) of the outlet temperature sensor, the computing device 52 calculates, on the basis of the physical property table, a saturated liquid enthalpy Hls and a saturated gas enthalpy Hgs of the refrigerant flowing out of the expansion device 16*b*. Then, the computing device 52 proceeds to step ST4.

(Step ST4)

The computing device 52 calculates a quality Xr on the basis of the inlet liquid enthalpy Hin calculated in step ST2, the saturated liquid enthalpy Hls and the saturated gas enthalpy Hgs calculated in step ST3, and Equation 1 described above. Then, the computing device 52 proceeds to step ST5.

As described in step ST2, since the composition ratio of the charged non-azeotropic refrigerant mixture is used as the refrigerant composition, the calculated quality Xr is a quality Xr in the charged composition.

(Step ST5)

On the basis of the quality Xr obtained in step ST4, a predetermined temperature glide ΔT, TH2 detected in step ST1, and Equation 2 described above, the computing device 52 calculates an evaporating temperature Te*. Then, the computing device 52 proceeds to step ST6.

(Step ST6)

On the basis of the quality Xr obtained in step ST4, the predetermined temperature glide ΔT, TH2 detected in step ST1, and Equation 3 described above, the computing device 52 calculates a dew-point temperature Tdew*. Then, the computing device 52 proceeds to step ST7.

(Step ST7)

The computing device 52 outputs the evaporating temperature Te* and the dew-point temperature Tdew* calculated in step ST6 to the controller 58.

A temperature glide of a saturated pressure at an evaporating temperature serving as a main control target may be used as the temperature glide ΔT. In Embodiment, a temperature glide of a saturated pressure at an evaporating temperature of 0 degrees C. is used as the temperature glide ΔT. For example, a refrigerant mixture R32/HFO1234yf having a GWP of 300 contains 44 wt % R32 and 56 wt % HFO1234yf. In this case, an evaporating pressure corresponding to an evaporating temperature of 0 degrees C. is 676.8 (kPa abs), at which the dew-point temperature is 1.95 (degrees C.), the boiling temperature is −1.87 (degrees C.), and the temperature glide ΔT is 3.82 (degrees C.).

For example, a refrigerant mixture R32/HFO1234yf having a GWP of 150 contains 22 wt % R32 and 78 wt % HFO1234yf. In this case, an evaporating pressure corresponding to an evaporating temperature of 0 degrees C. is 544.6 (kPa abs), at which the dew-point temperature is 4.49 (degrees C.), the boiling temperature is −4.12 (degrees C.), and the temperature glide ΔT is 8.61 (degrees C.).

For example, a refrigerant mixture R32/HFO1234ze (E) having a GWP of 300 contains 44 wt % R32 and 56 wt % HFO1234ze (E). In this case, an evaporating pressure corresponding to an evaporating temperature of 0 degrees C. is 549.5 (kPa abs), at which the dew-point temperature is 4.66 (degrees C.), the boiling temperature is −4.29 (degrees C.), and the temperature glide ΔT is 8.95 (degrees C.).

For example, a refrigerant mixture R32/HFO1234ze (E) having a GWP of 150 contains 22 wt % R32 and 78 wt % HFO1234ze (E). In this case, an evaporating pressure corresponding to an evaporating temperature of 0 degrees C. is 415.1 (kPa abs), at which the dew-point temperature is 6.81 (degrees C.), the boiling temperature is −6.00 (degrees C.), and the temperature glide ΔT is 12.81 (degrees C.).

As can be seen from above, the temperature glide varies significantly depending on the type of refrigerant and the composition ratio. Therefore, the temperature glide needs to be set for each type of refrigerant and each composition ratio. For a temperature glide, a pressure at which a mean temperature of a dew-point temperature and a boiling temperature is about 0 degrees C. may be set as a predetermined pressure. In the air-conditioning apparatus 100, a temperature glide in the case of using a refrigerant mixture of R32 and HFO1234yf is set to 3.0 degrees C. to 9.0 degrees C., and a temperature glide in the case of using a refrigerant mixture of R32 and HFO1234ze (E) is set to 8.0 degrees C. to 13.0 degrees C.

The physical property values are obtained from the REFPROP Version 9.0 released by the National Institute of Standards and Technology (NIST).

Calculation results to be described below are those obtained when a non-azeotropic refrigerant mixture composed of R32 and R134a is used. This is because using a non-azeotropic refrigerant mixture composed of R32 and R134a provides better data accuracy. The mixture contains 66 wt % R32 and 34 wt % R134a.

Figure 11:
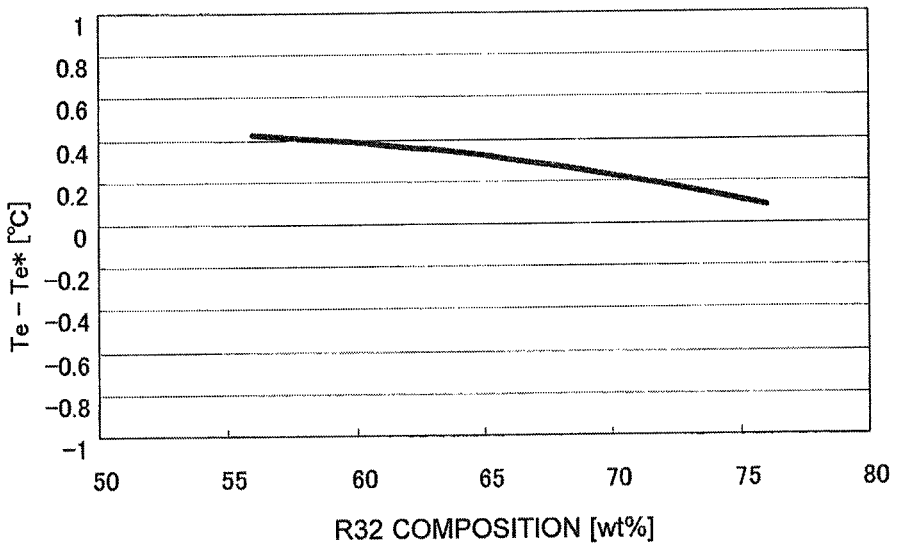
FIG. 11 illustrates a relationship between a difference between an evaporating temperature and an actual evaporating temperature and an R32 circulation composition.
Figure 12:
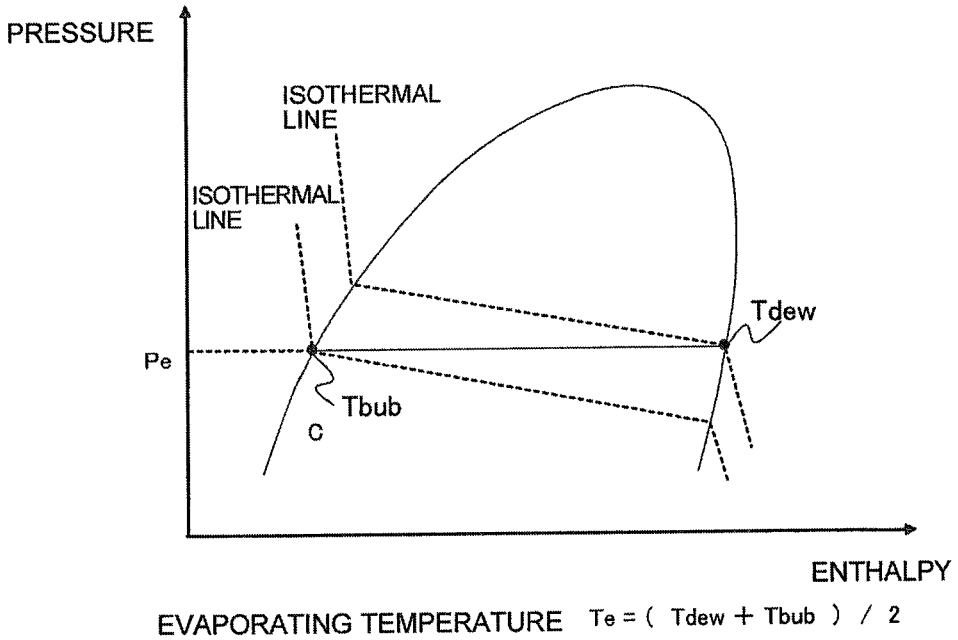
FIG. 12 illustrates a definition of an evaporating temperature Te.

A difference between the evaporating temperature Te* determined in the control flow of FIG. 10 and an actual evaporating temperature Te is shown in FIG. 11. A difference between the evaporating temperature Te* and the evaporating temperature Te represents a calculation error in the present invention. As shown in FIG. 12, the actual evaporating temperature Te is an arithmetic average of the boiling temperature Tbub and the dew-point temperature Tdew at an evaporating pressure Pe (Te=(Tbub+Tdew)/2). The evaporating pressure Pe is 650 (kPa abs) (an evaporating temperature of about 0 degrees C.), and TH1 is 44 degrees C. FIG. 11 illustrates a relationship between a difference between an evaporating temperature and an actual evaporating temperature (vertical axis) and an R32 circulation composition (horizontal axis). FIG. 12 illustrates a definition of an evaporating temperature Te. In FIG. 12, the horizontal axis represents enthalpy, and the vertical axis represents pressure.

The term 0.5 inside the parentheses in Equation 2 described above is used so that a quality Xr for the evaporating temperature Te which is an arithmetic average of the dew-point temperature and the boiling temperature is around 0.5. The evaporating temperature is a different value when the arithmetic average described in Embodiment is not used. That is, the value of the term 0.5 inside the parentheses in Equation 2 varies depending on how the evaporating temperature is defined. The term 0.5 inside the parentheses in Equation 2 described above is set to be in the range of 0.3 to 0.7.

Figure 13:
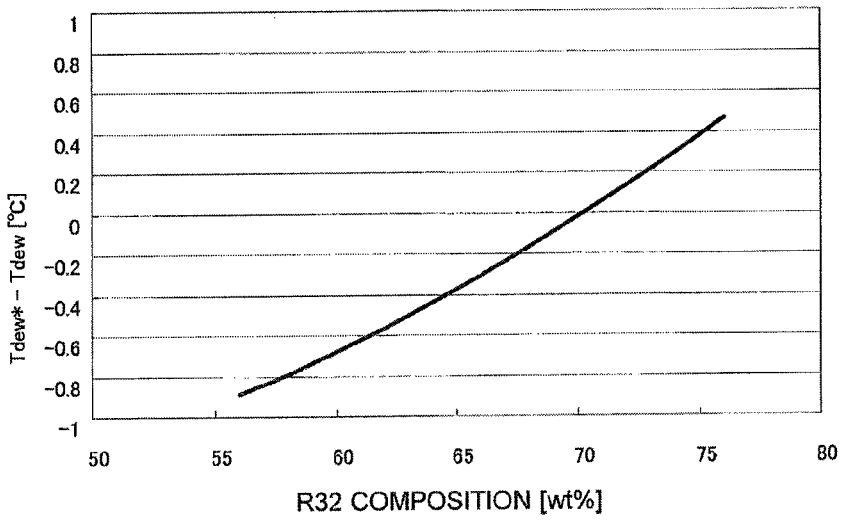
FIG. 13 illustrates a relationship between a difference between a dew-point temperature and an actual dew-point temperature and an R32 circulation composition.

As illustrated in FIG. 13, in actual operation, the R32 circulation composition is expected to change from 56% to 76%. A difference between the evaporating temperature Te* and the actual evaporating temperature Te in this range is about +0.4 degrees C. at a maximum. FIG. 13 illustrates a relationship between a difference between a dew-point temperature and an actual dew-point temperature (vertical axis) and an R32 circulation composition (horizontal axis).

Figure 14:
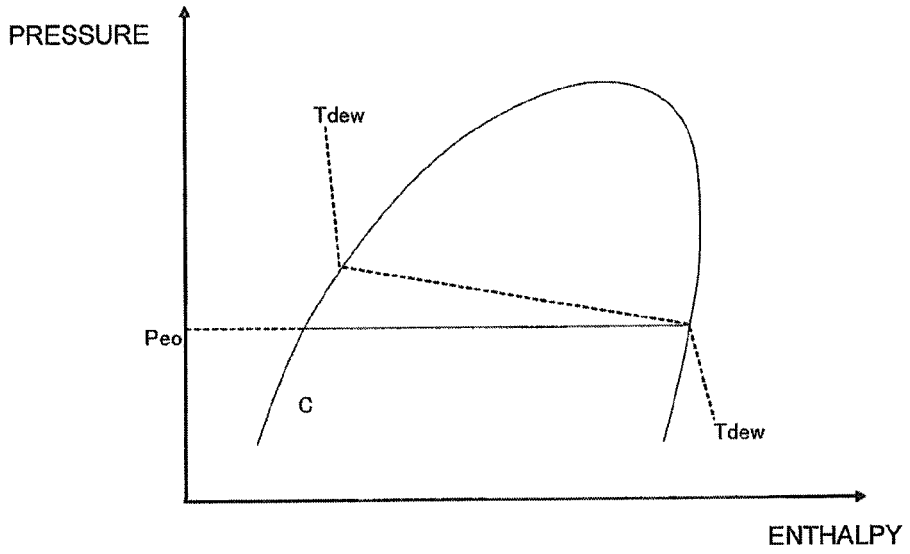
FIG. 14 illustrates a difference between a dew-point temperature determined in the control flow of FIG. 10 and an actual dew-point temperature.

A difference between the dew-point temperature Tdew* determined in the control flow of FIG. 10 and an actual dew-point temperature Tdew is shown in FIG. 14. The difference between the dew-point temperature Tdew* and the dew-point temperature Tdew represents a calculation error in the present invention. As shown in FIG. 14, the actual dew-point temperature Tdew is a dew-point temperature Tdew at an evaporator outlet pressure Peo. The evaporator outlet pressure Peo is 650 (kPa abs) (an evaporating temperature of about 0 degrees C.), and TH1 is 44 degrees C.

The term 1.0 inside the parentheses in Equation 3 described above is used so that a quality Xr for the dew-point temperature Tdew is 1.0.

In actual operation, the R32 circulation composition is expected to change from 56% to 76%. A difference between the dew-point temperature Tdew* and the actual dew-point temperature Tdew in this range is about +0.9 degrees C. at a maximum.

Next, a description will be given of why an evaporating temperature and a dew-point temperature can be calculated by a simple method performed by the air-conditioning apparatus 100 with relatively high accuracy.

Figure 15:
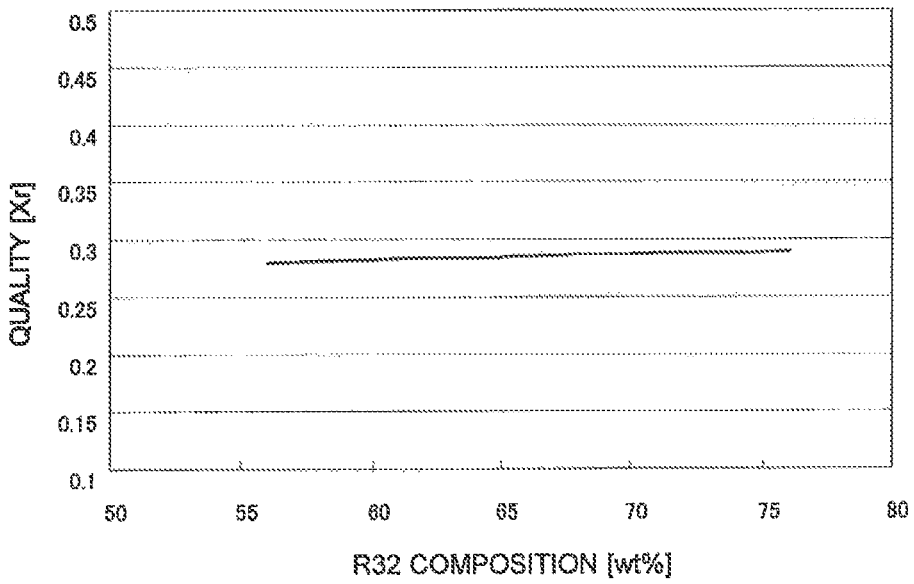
FIG. 15 illustrates a relationship between a quality and a refrigerant composition of R32.

A relationship between a quality Xr and an R32 composition will be described with reference to FIG. 15. FIG. 15 shows that there is little change in quality Xr with a change in the refrigerant composition of R32. A change in refrigerant composition $\alpha$ has little impact on the quality Xr determined in step ST4 of FIG. 10. Therefore, even when the quality Xr determined from a tentative set value is used, a dew-point temperature and an evaporating temperature can be calculated with high accuracy.

In the calculation of a dew-point temperature and an evaporating temperature, the air-conditioning apparatus 100 calculates a quality Xr in step ST4 of FIG. 10, calculates an evaporating temperature Te* in step ST5, and calculates a dew-point temperature Tdew* in step ST6.

That is, for calculating a dew-point temperature and an evaporating temperature, a preferable estimation method is to make estimation through the use of the quality, because the estimation is free from the impact of a change in composition. Thus, the air-conditioning apparatus 100 uses this calculation method and calculates a refrigerant composition with high accuracy.

As described above, by providing relatively low-cost temperature sensors (thermistors in Embodiment) before and after the expansion device 16*b*, an evaporating temperature and a dew-point temperature can be calculated with high accuracy. Thus, the air-conditioning apparatus 100 can properly control an evaporating temperature and a degree of superheat at the evaporator outlet that have a significant impact on performance of a refrigeration cycle, and can achieve high efficiency and low cost.

An evaporating temperature and a dew-point temperature are calculated in the heat medium relay unit 3. The calculated evaporating temperature and dew-point temperature are used to control actuators in the heat medium relay unit 3, and are at the same time transmitted to the outdoor unit 1 and used to control actuators in the outdoor unit 1.

An air-conditioning apparatus of indirect type has been described in Embodiment. When temperature sensors are provided at locations where a high-pressure liquid temperature and a low-pressure two-phase temperature can be measured, an evaporating temperature and a dew-point temperature can be calculated by the method described above.

Figure 16:
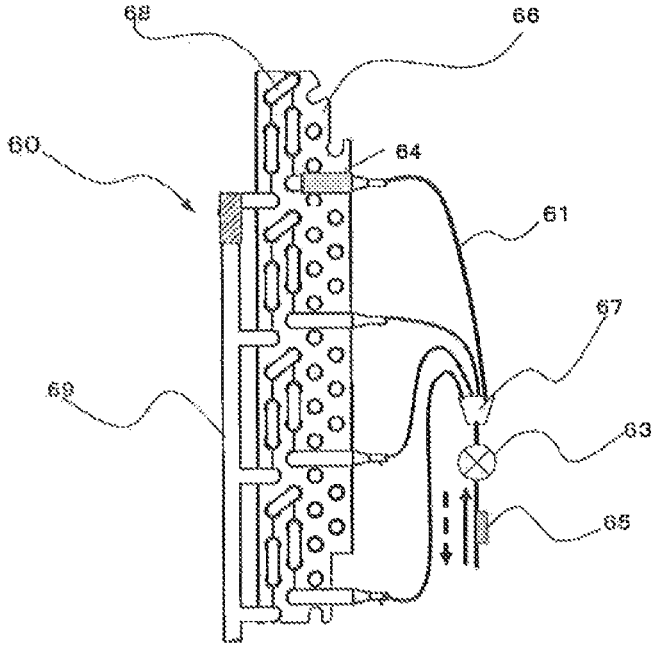
FIG. 16 is a schematic side view of an indoor heat exchanger included in an indoor unit that forms a direct expansion air-conditioning apparatus.

In the case of a direct expansion air-conditioning apparatus, as illustrated in FIG. 16, when temperature sensors are provided at two locations in an indoor heat exchanger included in an indoor unit, it is possible to calculate an evaporating temperature and a dew-point temperature as described above. FIG. 16 is a schematic side view of an indoor heat exchanger 60 included in an indoor unit that forms a direct expansion air-conditioning apparatus. The locations of the temperature sensors (a fifth temperature sensor 64 and a sixth temperature sensor 65) in the indoor heat exchanger 60 will be described with reference to FIG. 16.

As illustrated in FIG. 16, the indoor heat exchanger 60 is obtained by inserting, for example, heat transfer pipes 68 having a flat or circular cross-section into a plurality of plate-like fins 66 arranged at predetermined intervals. The fins 66 each have insertion holes which are equal in number to the heat transfer pipes and are spaced apart equally. A header 69 that divides or combines refrigerants depending on the refrigerant flow is connected to one end portions of the heat transfer pipes 68. A distributor 67 that divides or combines refrigerants depending on the refrigerant flow is connected via extension pipes 61 to the other end portions of the heat transfer pipes 68.

An expansion device 63 is connected to an inlet and outlet side of the distributor 67 remote from the indoor heat exchanger 60. Like the expansion devices 16 described above, the expansion device 63 reduces the pressure of the heat-source-side refrigerant and expands it. The expansion device 63 may be formed by a device having a variably controllable opening degree, such as an electronic expansion valve. The fifth temperature sensor 64 is provided in part of a heat transfer pipe 68 of the indoor heat exchanger 60. The fifth temperature sensor 64 detects the temperature of the refrigerant flowing in the heat transfer pipe 68. Additionally, the sixth temperature sensor 65 is provided on an inlet and outlet side of the expansion device 63 remote from the distributor 67. The sixth temperature sensor 65 detects the temperature of the refrigerant flowing in the pipe. These temperature sensors may also be formed by thermistors.

When the refrigerant flows in the direction of a solid arrow, the sixth temperature sensor 65 detects a high-pressure liquid temperature TH1 and the fifth temperature sensor 64 calculates a low-pressure two-phase temperature TH2. When the refrigerant flows in the direction of a dashed arrow, the fifth temperature sensor 64 detects the high-pressure liquid temperature TH1 and the sixth temperature sensor calculates the low-pressure two-phase temperature TH2. The calculation is made in accordance with the control flow illustrated in FIG. 10. Thus, even in the case of a direct expansion air-conditioning apparatus, an evaporating temperature and a dew-point temperature can be calculated as described above.

The first heat medium flow switching devices 22 and the second heat medium flow switching devices 23 described in Embodiment may each be of any type which is capable of switching a passage, such as a three-way valve capable of switching a three-way passage, or a combination of two on-off valves capable of opening and closing a two-way passage. A stepping-motor-driven mixing valve or the like capable of changing the flow rate in a three-way passage, or a combination of two electronic expansion valves or the like capable of changing the flow rate in a two-way passage, may be used as each of the first heat medium flow switching devices 22 and the second heat medium flow switching devices 23. In this case, it is possible to prevent water hammer caused by sudden opening or closing of the passage. Embodiment has described an example where the heat medium flow control devices 25 are each a two-way valve. However, the heat medium flow control devices 25 may each be a control valve with a three-way passage, and may each be positioned together with a bypass pipe that bypasses the corresponding use-side heat exchanger 26.

The heat medium flow control devices 25 may each be of a stepping-motor-driven type capable of controlling the flow rate in the passage, and may each be a two-way valve or a three-way valve closed at one end. The heat medium flow control devices 25 may each be an on-off valve or the like that opens and closes a two-way passage and controls an average flow rate by repeating an ON/OFF operation.

Although the second refrigerant flow switching devices 18 have been described as each being like a four-way valve, the configuration is not limited to this. The second refrigerant flow switching devices 18 may each be formed by a plurality of two-way or three-way flow switching valves and configured such that the refrigerant flows in the same manner as described above.

Although the air-conditioning apparatus 100 according to Embodiment has been described as being capable of performing a cooling and heating mixed operation, the air-conditioning apparatus 100 is not limited to this. The same effect can be achieved even if the air-conditioning apparatus 100 includes one intermediate heat exchanger 15 and one expansion device 16 to which a plurality of heat medium flow control devices 25 and a plurality of use-side heat exchangers 26 are connected in parallel, so that the air-conditioning apparatus 100 can perform only one of the heating operation and the cooling operation.

The same applies to the case where only one use-side heat exchanger 26 and only one heat medium flow control device 25 are connected. The intermediate heat exchangers 15 and the expansion devices 16 may be replaced by a plurality of components having the same functions as those of the intermediate heat exchangers 15 and the expansion devices 16. Although the heat medium flow control devices 25 are included in the heat medium relay unit 3 in the example described above, the configuration is not limited to this. Each heat medium flow control device 25 may be included in the indoor unit 2, or may be configured as a unit separate from both the heat medium relay unit 3 and the indoor unit 2.

Examples of the heat medium that can be used include brine (antifreeze), water, a mixed solution of brine and water, and a mixed solution of water and an anti-corrosive additive. Thus, in the air-conditioning apparatus 100, even if the heat medium leaks through any indoor unit 2 into the indoor space 7, since the heat medium is safe, it is possible to contribute to improved safety.

Although Embodiment has described an example where the air-conditioning apparatus 100 includes the accumulator 19, the air-conditioning apparatus 100 does not have to include the accumulator 19. Although the heat-source-side heat exchanger 12 and each of the use-side heat exchangers 26 are each typically provided with an air-sending device which sends air to promote condensation or evaporation, the configuration is not limited to this. For example, a panel heater that uses radiation may be used as the use-side heat exchanger 26, and a water-cooled heat exchanger that transfers heat through water or antifreeze may be used as the heat-source-side heat exchanger 12. That is, the heat-source-side heat exchanger 12 and the use-side heat exchanger 26 may be of any types, as long as they are configured to be capable of transferring or receiving heat.

Although Embodiment has described an example where there are four use-side heat exchangers 26, the number of the use-side heat exchangers 26 is not limited to this. Although there are two intermediate heat exchangers 15 (the intermediate heat exchanger 15*a* and the intermediate heat exchanger 15*b*) in the example described above, the number of the intermediate heat exchangers 15 is not limited to this. There may be any number of intermediate heat exchangers 15 as long as the heat medium can be cooled or/and heated. The number of the pump 21*a* and the pump 21*b* each is not limited to one. There may be a plurality of small-capacity pumps arranged in parallel and connected together.

REFERENCE SIGNS LIST

1 outdoor unit, 2 indoor unit, 2*a* indoor unit, 2*b* indoor unit, 2*c* indoor unit, 2*d* indoor unit, 3 heat medium relay unit, 4 refrigerant pipe, 4*a* first connecting pipe, 4*b* second connecting pipe, 5 pipe, 6 outdoor space, 7 indoor space, 8 space, 9 building, 10 compressor, 11 first refrigerant flow switching device, 12 heat-source-side heat exchanger, 13*a* check valve, 13*b* check valve, 13*c* check valve, 13*d* check valve, 15 intermediate heat exchanger, 15*a* intermediate heat exchanger, 15*b* intermediate heat exchanger, 16 expansion device, 16*a* expansion device, 16*b* expansion device, 17 opening and closing device, 17*a* opening and closing device, 17*b* opening and closing device, 18 second refrigerant flow switching device, 18*a* second refrigerant flow switching device, 18*b* second refrigerant flow switching device, 19 accumulator, 21 pump, 21*a* pump, 21*b* pump, 22 first heat medium flow switching device, 22*a* first heat medium flow switching device, 22*b* first heat medium flow switching device, 22*c* first heat medium flow switching device, 22*d* first heat medium flow switching device, 23 second heat medium flow switching device, 23*a* second heat medium flow switching device, 23*b* second heat medium flow switching device, 23*c* second heat medium flow switching device, 23*d* second heat medium flow switching device, 25 heat medium flow control device, 25*a* heat medium flow control device, 25*b* heat medium flow control device, 25*c* heat medium flow control device, 25*d* heat medium flow control device, 26 use-side heat exchanger, 26*a* use-side heat exchanger, 26*b* use-side heat exchanger, 26*c* use-side heat exchanger, 26*d* use-side heat exchanger, 31 first temperature sensor, 31*a* first temperature sensor, 31*b* first temperature sensor, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 50 fourth temperature sensor, 52 computing device, 57 controller, 58 controller, 60 indoor heat exchanger, 61 extension pipe, 63 expansion device, 64 fifth temperature sensor, 65 sixth temperature sensor, 66 fin, 67 distributor, 68 heat transfer pipe, 69 header, and 100 air-conditioning apparatus.

The invention claimed is:

1. An air-conditioning apparatus that operates in a heating mode or a cooling mode by sending heated or cooled air into an air-condition space for heating or cooling the space, in which a compressor, a first heat exchanger, an expansion device, and a second heat exchanger are connected by pipes to form a refrigeration cycle, and a non-azeotropic refrigerant mixture is adopted as a refrigerant circulating in the refrigeration cycle, the air-conditioning apparatus comprising:

a first temperature detection device disposed on an inlet side of the expansion device, a second temperature detection device disposed on an outlet side of the expansion device; and a controller configured to control operation of the air-conditioning apparatus in the heating mode or the cooling mode based in part on calculating an evaporating temperature Te* and a dew-point temperature Tdew* from a quality Xr of the refrigerant on a downstream side of the expansion device, a temperature glide ΔT determined by a difference between a boiling temperature and a dew-point temperature at a predetermined pressure, and a refrigerant temperature detected by the second temperature detection device, wherein the quality Xr is calculated on a basis of an inlet liquid enthalpy calculated on a basis of a refrigerant temperature detected by the first temperature detection device, and a saturated liquid enthalpy and a saturated gas enthalpy are calculated on a basis of the refrigerant temperature detected by the second temperature detection device.

2. The air-conditioning apparatus of claim 1, wherein the evaporating temperature Te* is calculated by "detected temperature of second temperature detection device+temperature glide ΔT×(predetermined value−quality Xr)", and the predetermined value is set to 0.3 to 0.7.

3. The air-conditioning apparatus of claim 2, wherein the predetermined value is set to 0.5.

4. The air-conditioning apparatus of claim 1, wherein the dew-point temperature Tdew* is calculated by "detected temperature of second temperature detection device+temperature glide ΔT×(1.0−quality Xr)".

5. The air-conditioning apparatus of claim 1, wherein the predetermined pressure is a saturated pressure at an evaporating temperature serving as a control target of the refrigeration cycle.

6. The air-conditioning apparatus of claim 1, wherein the predetermined pressure is a saturated pressure at which a mean temperature of the dew-point temperature and the boiling temperature is about 0 degrees C.

7. The air-conditioning apparatus of claim 1, wherein the controller is configured to include:

a step of calculating the inlet liquid enthalpy on the basis of the refrigerant temperature detected by the first temperature detection device;

a step of calculating the saturated liquid enthalpy and the saturated gas enthalpy on the basis of the refrigerant temperature detected by the second temperature detection device;

a step of calculating the quality Xr of the refrigerant on the downstream side of the expansion device on the basis of the inlet liquid enthalpy, the saturated liquid enthalpy, and the saturated gas enthalpy;

a step of calculating the evaporating temperature Te* from the quality Xr, the temperature glide ΔT determined in advance, and the refrigerant temperature detected by the second temperature detection device; and a step of calculating the dew-point temperature Tdew* from the quality Xr, the temperature glide ΔT determined in advance, and the refrigerant temperature detected by the second temperature detection device.

8. The air-conditioning apparatus of claim 1, wherein a refrigerant mixture of R32 and HFO1234yf is used as the non-azeotropic refrigerant mixture, and the temperature glide ΔT is set to 3.0 degrees C. to 9.0 degrees C.

9. The air-conditioning apparatus of claim 1, wherein a refrigerant mixture of R32 and HFO1234ze (E) is used as the non-azeotropic refrigerant mixture, and the temperature glide ΔT is set to 8.0 degrees C. to 13.0 degrees C.

* * * * *